US005932327A

United States Patent [19]

Inoguchi et al.

[11] Patent Number: 5,932,327

[45] Date of Patent: Aug. 3, 1999

[54] ELECTROLUMINESCENT ELEMENT

[75] Inventors: Kazuhiro Inoguchi, Toyota; Hajime Ishihara, Nagoya; Masayuki Katayama, Handa; Nobuei Ito, Chiryu; Tadashi Hattori, Okazaki, all of Japan

[73] Assignee: Nippondenso Co., Ltd., Kariya, Japan

[21] Appl. No.: 08/598,529

[22] Filed: Feb. 8, 1996

[30] Foreign Application Priority Data

| | | | |
|---|---|---|---|
| Feb. 9, 1995 | [JP] | Japan | 7-046446 |
| Jul. 24, 1995 | [JP] | Japan | 7-187368 |
| Dec. 21, 1995 | [JP] | Japan | 7-333558 |

[51] Int. Cl.[6] ..... H05B 33/00

[52] U.S. Cl. ..... 428/212; 428/690; 428/699; 428/917; 313/500; 313/503; 313/506; 313/509; 257/88; 257/98; 257/102

[58] Field of Search ..... 313/509, 498, 313/506, 504, 503, 500, 502; 428/411.1, 212, 457, 690, 704, 699, 917; 257/88, 89, 90, 91, 98, 102, 103

[56] References Cited

U.S. PATENT DOCUMENTS

| | | | |
|---|---|---|---|
| 4,937,150 | 6/1990 | Tsukada | 428/690 |
| 5,369,333 | 11/1994 | Inoguchi et al. | 313/509 |
| 5,384,517 | 1/1995 | Uno | 315/169.3 |
| 5,432,014 | 7/1995 | Sano et al. | 428/690 |
| 5,540,999 | 7/1996 | Yamamoto et al. | 428/411.1 |
| 5,589,733 | 12/1996 | Noda et al. | 313/509 |
| 5,598,059 | 1/1997 | Sun et al. | 313/509 |
| 5,641,582 | 6/1997 | Nire et al. | 428/690 |
| 5,712,051 | 1/1998 | Sugiura et al. | 428/690 |
| 5,742,322 | 4/1998 | Cranton et al. | 347/238 |

FOREIGN PATENT DOCUMENTS

| | | |
|---|---|---|
| 60-015115 | 4/1985 | Japan . |
| 2-112195 | 4/1990 | Japan . |
| 4-190588 | 7/1992 | Japan . |

OTHER PUBLICATIONS

Ono, "Seminar F–1: Electroluminescent Displays", Society For Information Display (SID) 1993, Seminar Lecture Notes vol. II: May 17, ISSN 0887–915X, pp. F–1/3–F–1/9, F–1/18–F–1/25.

Ono, "Electroluminescent Displays", World Scientific Publishing Co. Pte. Ltd., 1995, pp. 26–43.

Chen, et al., "Limitation imposed by field clamping on the efficiency of high–field ac electrolumnescence in thin films", J. Appl. Phys., vol. 43, No. 10, Oct. 1972, pp. 4089–4096.

*Primary Examiner*—Marie Yamnitzky

*Attorney, Agent, or Firm*—Pillsbury Madison & Sutro LLP

[57] ABSTRACT

An electroluminescent element includes a glass substrate, on which are formed a first electrode, a first insulating layer, a first luminescent layer, a second luminescent layer, a second insulating layer, a second electrode, a protective film and a red color filter. In this structure, the first luminescent layer is made of ZnS having Mn added thereto, and the second luminescent layer is made of ZnS having Tb added thereto. Here, the clamp electric field intensity of the second luminescent layer is higher than that of the first luminescent layer, and the product of a dielectric constant and clamp electric field intensity of the first luminescent layer is larger than the product of a dielectric constant and clamp electric field intensity of the second luminescent layer. Consequently, it is possible to increase the luminance of light emitted from the luminescent layer and decrease the luminescence threshold voltage when the luminescent layer is made into a stacked layer structure.

42 Claims, 26 Drawing Sheets

ELECTROLUMINESCENT ELEMENT

CROSS REFERENCE TO RELATED APPLICATION

This application is based upon and claims the benefit of priority of the prior Japanese Patent Applications No. 7-46446 filed on Feb. 9, 1995, No. 7-187368 filed on Jul. 24, 1995 and No. 7-333558 filed on Dec. 21, 1995, the contents of which are incorporated herein by reference.

BACKGROUND OF THE INVENTION

1. Field of the Invention

The present invention relates to an electroluminescent element and, particularly, to an electroluminescent element enabling emission of multi-color light.

2. Description of the Related Art

The color of light emitted from an electroluminescent element is yellowish orange color when ZnS (zinc sulfide) is used as host material and Mn (manganese) serving as a luminescent center is added thereto while, on the other hand, it is green color when Tb (terbium) serving as a luminescent center is added thereto.

Unexamined Japanese Patent Application No. H2-112195 describes an electroluminescent element wherein a luminescent layer of ZnS:Mn using ZnS as host material and having Mn, serving as a luminescent center, added thereto and a luminescent layer of ZnS:Tb using ZnS as host material and having Tb, serving as a luminescent center, added thereto are stacked one upon the other. Red-color and green-color filters are provided on the resulting structure, thereby allowing for emission of multi-color light.

In the above-mentioned electroluminescent element, since two luminescent layers are stacked, a drive voltage (luminescence threshold voltage) becomes high if luminescent layers each having a thickness the same as that in the case of a single-layer electroluminescent element are stacked as they are. Accordingly, in order to decrease the luminescence threshold voltage, it is necessary to decrease the thickness of each luminescent layer, which, however, causes the problem that the luminance of light emitted also decreases.

Also, since the use of color filters are needed for color separation, the luminance of emitted light further decreases due to transmission loss caused by the filters.

SUMMARY OF THE INVENTION

The present invention has been made in view of the above and an object of the present invention is to increase the luminance of light emitted from the luminescent layer per se.

Another object of the present invention is to decrease the luminescence threshold voltage.

An electroluminescent element according to the present invention basically comprises a pair of electrodes at least one of which is transparent, and an insulating layer, a luminescent layer and a compound semiconductor layer disposed to be stacked with respect to the luminescent layer, all of which are disposed between the pair of electrodes. The present invention is characterized in that the compound semiconductor layer has a clamp electric field intensity higher than that of the luminescent layer.

Furthermore, it is preferable that the product of a dielectric constant and clamp electric field intensity of the luminescent layer should be larger than the product of a dielectric constant and clamp electric field intensity of the compound semiconductor layer.

Herein, the compound semiconductor layer is utilizable as another luminescent layer for emitting visible or invisible light.

BRIEF DESCRIPTION OF THE DRAWINGS

These and other objects, features and characteristics of the present invention will be appreciated from a study of the following detailed description, the appended claims, and drawings, all of which form a part of this application. In the drawings:

FIGS. 12 and 13 are views illustrating a relationship between second electrodes 7*a* and 7*b* and the width of a red color filter 9 of the second embodiment of the present invention, wherein FIG. 12 illustrates a structure the red color filter 9 of which is so formed that the widthwise edge thereof is in contact with an end of the second electrode 7*b*, and FIG. 13 illustrates a structure the red color filter 9 of which is so formed that the widthwise edge thereof is located apart from the end of the second electrode 7*b;*

DETAILED DESCRIPTION OF THE PRESENTLY PREFERRED EXEMPLARY EMBODIMENTS

The present inventors conducted their earnest studies on an electroluminescent element wherein a luminescent layer of ZnS:Mn and a luminescent layer of ZnS:Tb were stacked one upon the other. As a result, they have found out, after having performed experiments under certain manufacturing conditions, that whether the luminescent layer of ZnS:Mn is disposed as an upper layer or as a lower layer, there sometimes occurs the phenomenon that the luminance of the stacked luminescent layer of ZnS:Mn per unit thickness thereof increases compared to that of a single luminescent layer of ZnS:Mn.

In a case where the luminescent layers have been stacked, it is described in Examined Japanese Patent Publication No. S60-15115 that the luminance of an upper luminescent layer increases. This is because the crystallinity of an upper luminescent layer increases.

However, according to the results of the above-mentioned experiments by the inventors, the luminance of the luminescent layer of ZnS:Mn increases even when this layer is disposed as a lower layer. On the basis of experiment data in the case where the above-mentioned phenomenon has occurred, the present inventors have come to the conclusion that it is likely that the clamp electric field intensity of each layer may be related to an increase in the luminance.

Figure 25:
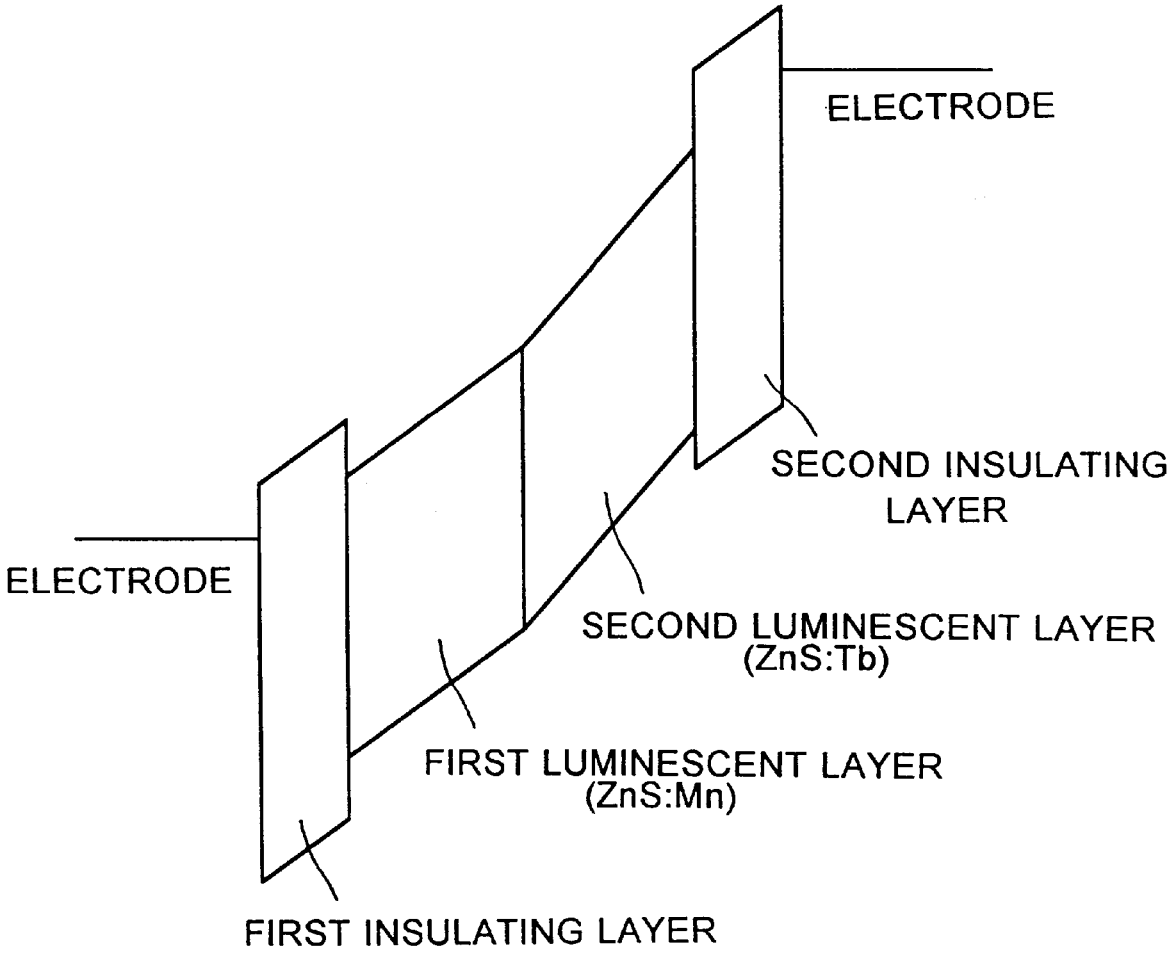
FIG. 25 is a band diagram illustrating an increase in luminance which occurs when electric charge has been injected from a second luminescent layer high in clamp electric field into a first luminescent layer.

This is considered to be because, as illustrated in a band view of FIG. 25, electric charge (hot electrons) in a luminescent layer (a second luminescent layer in the figure) high in the clamp electric field intensity is accelerated and injected with a high acceleration energy into a luminescent layer (a first luminescent layer in the figure) low in the clamp electric field intensity. Accordingly, as mentioned above, the luminescent layer of ZnS:Mn exhibits a high luminance.

In view of the above-mentioned considerations, in order to increase the luminance by making a stacked-layer structure, it is not necessary to stack two luminescent layers. Namely, it is sufficient that a luminescent layer desired to have its luminance increased be stacked on a compound semiconductor layer having a clamp electric field intensity higher than that of this luminescent layer.

In this case, since if the luminescent layer and the compound semiconductor layer are made of the same host material, an interface therebetween can have continuity, and it becomes easier to inject electric charge from the compound semiconductor layer high in clamp electric field intensity, thereby enabling an increase in the luminance.

Also, if the compound semiconductor layer is disposed on a side of the luminescent layer near to a substrate adjacently thereto, it becomes possible to improve the crystallinity of the luminescent layer and thereby further increase the luminance of the luminescent layer.

Also, if the compound semiconductor layer is made to be one that emits no electroluminescence in a range of visible light, it is possible to obtain a single color light of high luminance from the luminescent layer alone. For example, if ZnS is used as host material of the compound semiconductor layer, Cd (cadmium) or CdS can be incorporated therein as an additive. In this case, since a CdS semiconductor is small in the energy gap, it absorbs light in a range of visible light. Therefore, since the addition of Cd in large quantity is followed by blackening, it is necessary that the quantity of Cd added be set to several wt % or less so as to permit ZnS to exhibit its characteristic as the host material (transparency and the like).

Also, the compound semiconductor layer can be made to be one having electroluminescence similar to that of the luminescent layer. For example, if a compound semiconductor of $ZnS:TmF_3$ containing Tm (thulium) as an additive is stacked against a luminescent layer of $CaGa_2S_4$:Ce exhibiting a blue color light emission, it is possible to obtain very pure blue color light.

Figure 26:
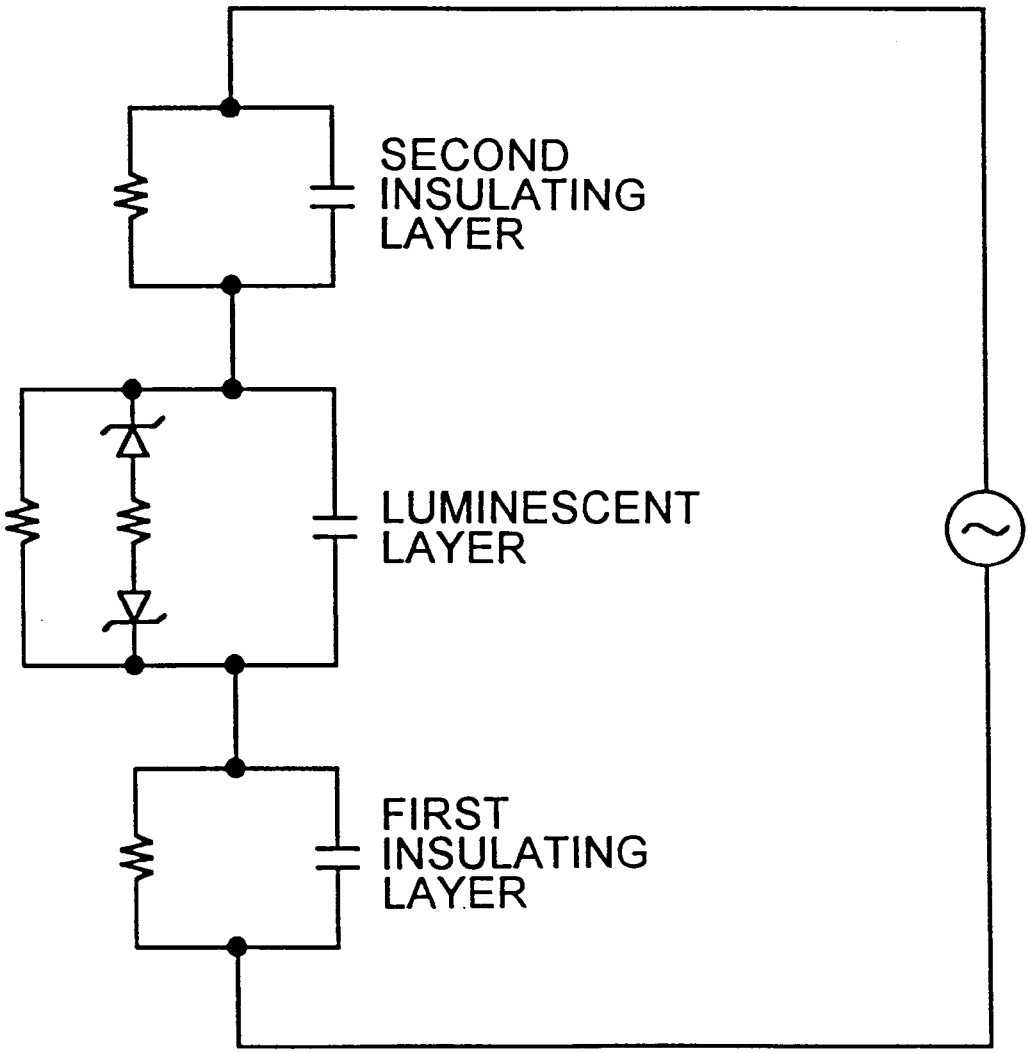
FIG. 26 is a circuit diagram illustrating an equivalent circuit composed of a first insulating layer, a luminescent layer and a second insulating layer.

Also, a first insulating layer, a luminescent layer and a second insulating layer can be represented by an equivalent circuit illustrated in FIG. 26. Assuming that the dielectric constant and thickness of the first insulating layer are respectively $\epsilon_{i1}$ and $d_{11}$; the dielectric constant and thickness of the luminescent layer are respectively $\epsilon_a$ and $d_a$; and the dielectric constant and thickness of the second insulating layer are respectively $e_{i2}$ and $d_{12}$, since the surface electric charges induced in the interfaces between the layers are equal, the equation (1) below is established:

$$\epsilon_0 \cdot \epsilon_{i1} \cdot S \cdot (V_{i1}/d_{11}) = \epsilon_0 \cdot \epsilon_a \cdot S \cdot (V_a/d_a) = \epsilon_0 \cdot \epsilon_{i2} \cdot S \cdot (V_{i2}/d_{12}) \quad (1)$$

wherein $\epsilon_0$ represents the dielectric constant in vacuum, S represents the area of the element, $V_{i1}$ represents the partial voltage of the first insulating layer, $V_a$ represents the partial voltage of the luminescent layer, and $V_{i2}$ represents the partial voltage of the second insulating layer.

At a time of clamp voltage, since $V_a/d_a$ represents the clamp electric field intensity $E_c$, the equations (2) and (3) below are established from the equation (1).

$$V_{i1} = (d_{11}/\epsilon_{i1}) \cdot \epsilon_a \cdot E_c \quad (2)$$

$$V_{i2} = (d_{i2}/\epsilon_{i2}) \cdot \epsilon_a \cdot E_c \quad (3)$$

Since the luminescent layer remains to be dielectric until it begins to emit light, in a case where the luminescent layer is constituted by stacking a first luminescent layer and a second luminescent layer, when any one of the luminescent layers begins to emit light, the other luminescent layer is dielectric. In this case, the electroluminescence threshold voltage $V_c$ is represented by the sum of the partial voltage of the luminescent layer beginning to emit light and the partial voltages which are respectively applied to the luminescent layer remaining to be dielectric and the first and second insulating layers. The partial voltages which are respectively applied to the luminescent layer remaining to be dielectric and the first and second insulating layers are determined, from the equations (2) and (3), depending upon the product of the dielectric constant and clamp electric field intensity of the luminescent layer beginning to emit light.

Such being the case, assuming that the dielectric constants of the first and second luminescent layers and the clamp electric field intensities thereof are $\epsilon_{a1}$, $\epsilon_{a2}$ and $E_{c1}$, $E_{c2}$, respectively, a luminescent layer which first emits light is determined depending upon whether the product of the dielectric constant and clamp electric field intensity of the first luminescent layer, $\epsilon_{a1} \times E_{c1}$, is larger or smaller than the product of the dielectric constant and clamp electric field intensity of the second layer, $\epsilon_{a2} \times E_{c2}$.

Usually, the luminescent layer low in clamp electric field intensity begins to emit light first. However, for example, even when the second luminescent layer is higher in clamp electric field intensity than the first luminescent layer, if the relationship of $\epsilon_{a1} \times E_{c1} > \epsilon_{a2} \times E_{c2}$ becomes established, the second luminescent layer high in clamp electric field intensity begins to emit light first.

With the above point in mind, the present inventors continued their study on the matter. As a result, it has been proven that there occurs the phenomenon that the first and second luminescent layers simultaneously emit light and, in this case, the luminescence threshold voltage decreases.

Figure 27:
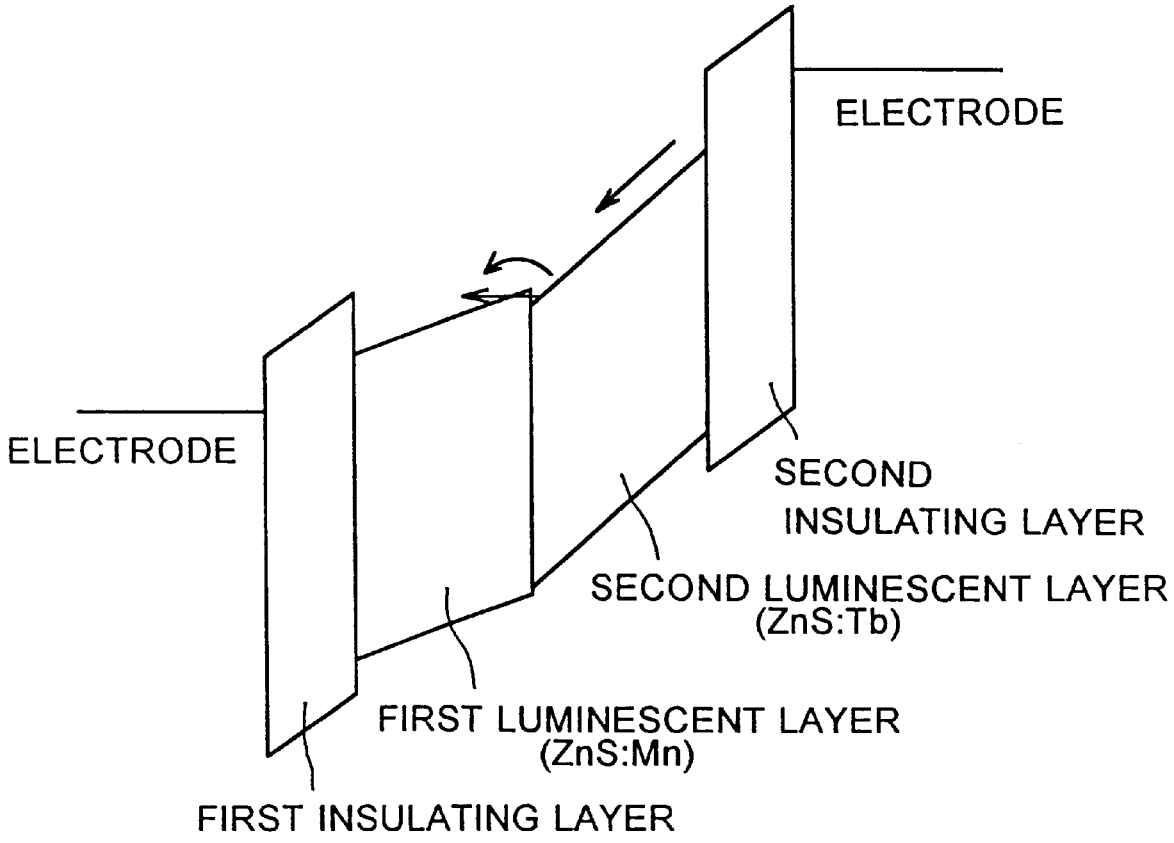
FIG. 27 is a band diagram illustrating a decrease in luminescence threshold voltage of the second luminescent layer which occurs when electric charge has been injected from a second luminescent layer high in clamp electric field into the first luminescent layer.

The reason for this is considered to be as follows. As illustrated in a band view of FIG. 27, when the second luminescent layer high in clamp electric field intensity has begun to emit light, electric charge of a high acceleration energy is forcedly injected into the first luminescent layer not reaching clamp voltage by tunneling or the like, thereby causing the first luminescent layer to emit light.

Also, where, as shown in a first embodiment as described later, a luminescent layer of ZnS:Mn is patterned and then a luminescent layer of ZnS:Tb is stacked thereon to thereby form a laminated portion and a single layer portion, when the luminescent layer of ZnS:Tb is formed to a thickness of 5,000 Å and the thickness of the luminescent layer of ZnS:Mn has been varied from 1,000 Å to 3,500 Å, the phenomenon that the laminated portion and single layer portion emit light almost simultaneously has occurred.

Usually, when the luminescent layers are stacked, the thickness of the resulting layer structure becomes large. Therefore, the luminescence threshold voltage of the laminated portion becomes high. However, that the laminated portion and the single layer portion emit light almost simultaneously means that the luminescence threshold voltage of the luminescent layer of ZnS:Mn of the laminated portion has decreased down to that of the luminescent layer of ZnS:Tb.

On the other hand, when the thickness of the luminescent layer of ZnS:Mn has been made larger by degrees, the luminescence threshold voltage of the laminated portion has become gradually higher. The reason for this is considered to be that the effect of the luminescence threshold voltage of the ZnS:Mn luminescent layer per se has begun to appear gradually. Even in this case, the luminescence threshold voltage was sufficiently low compared to that of the ZnS:Mn luminescent layer as a single layer.

Judging from the above-mentioned phenomenon, in order to decrease the luminescence threshold voltage of the luminescent layer, it is not necessary to stack two luminescent layers. That is, it is sufficient that the luminescent layer and the compound semiconductor layer be stacked, the clamp electric field intensity of the compound semiconductor layer be made higher than that of the luminescent layer, and the product of the dielectric constant and clamp electric field intensity of the luminescent layer be larger than that of the dielectric constant and clamp electric field intensity of the compound semiconductor layer.

In this case, the luminescent layer and the compound semiconductor layer can be made of the same materials as stated previously in relation to an increase in the luminance of the emitted light.

Next, the above-mentioned clamp electric field intensity will be explained.

The wording "clamp electric field intensity" means the applied electric field intensity when an electric current begins to flow (at a time of clamp) upon application of voltage to the luminescent layer. Specifically, the clamp electric field intensity $E_c$ is defined as a value obtained by dividing the partial voltage $V_{cz}$ applied to the luminescent layer at a time of clamp by the thickness $d_z$ of the luminescent layer and is expressed by the equation (4) below.

$$E_c = V_{cz}/d_z \quad (4)$$

The partial voltage $V_{cz}$ applied to the luminescent layer at a time of clamp is determined by measuring the Q–V characteristic of the electroluminescent element by using a Sawyer-Tower circuit and from the hysteresis thereof.

Figure 28:
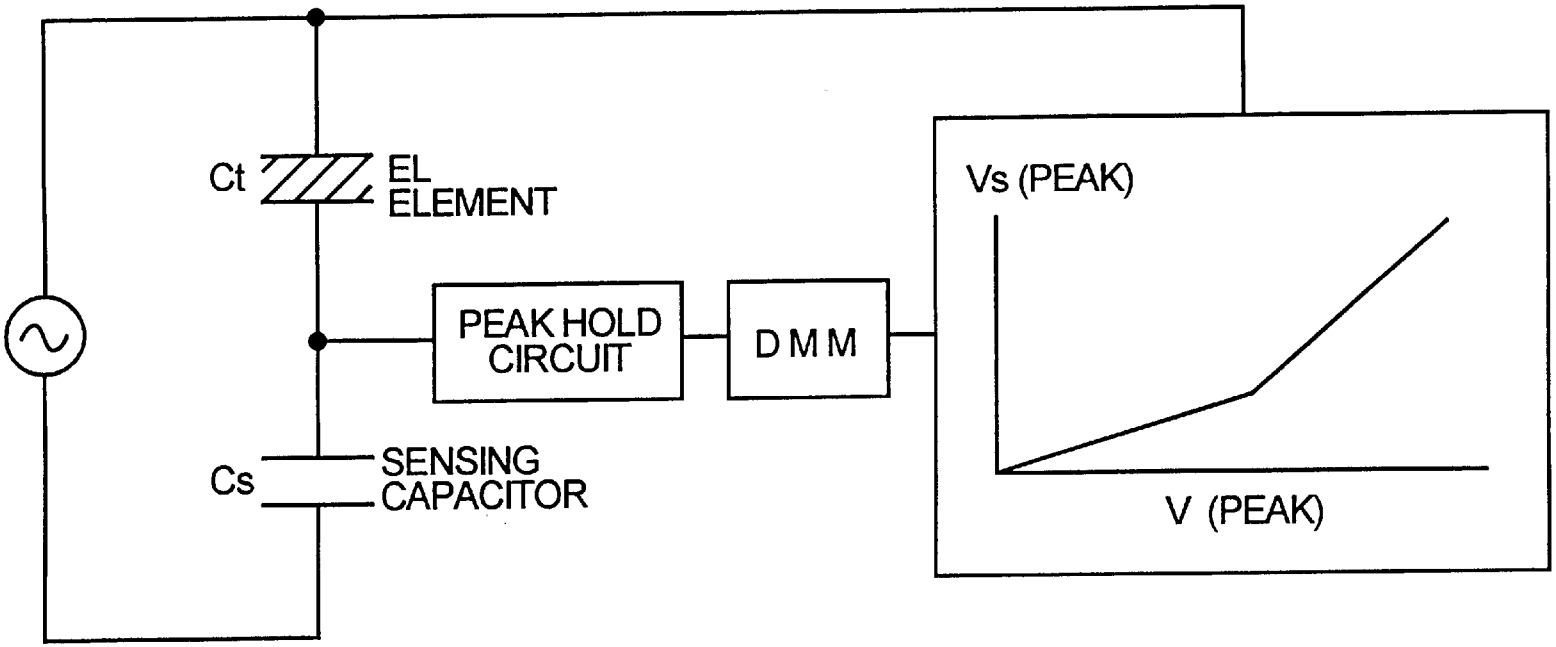
FIG. 28 is a diagram illustrating a measuring device for measuring the Q–V characteristic of the electroluminescent element.

In this experiment, a measuring device illustrated in FIG. 28 was used. The Q when the Q–V characteristic is measured is determined by measuring the voltage $V_s$ applied to a sense capacitor $C_s$ and using the equation (5) below.

$$Q = C_s \cdot V_s \quad (5)$$

In the measuring device illustrated in FIG. 28, a peak hold method in which a bent point of the Q–V characteristic appears comparatively remarkably is used. The voltage $V_s$ is measured by a digital multimeter (DMM) via a peak hold circuit.

Figure 29:
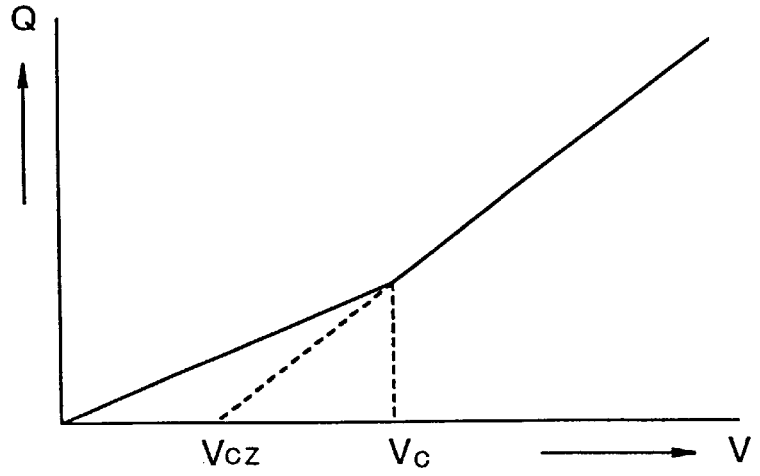
FIG. 29 is a graph illustrating the measured results of the Q–V characteristic.

The measured results of the Q–V characteristic are shown in FIG. 29. In this figure, $V_c$ represents the clamp voltage of the luminescent layer and $V_{cz}$ represents the partial voltage applied to the luminescent layer at a time of clamp. Accordingly, an extrapolating straight line is drawn from the Q–V characteristic to thereby determine the $V_{cz}$ and the clamp electric field intensity $E_c$ is determined from the equation (4).

Note the following. When an alternating current voltage is applied to the electroluminescent element, it sometimes happens that the value of the partial voltage $V_{cz}$ differs between an initial pulse and a pulse in a stationary state (several seconds thereafter). However, since the value of the partial voltage $V_{cz}$ determined in the stationary state can be regarded as an average clamp voltage of the electroluminescent element, the clamp electric field intensity can be determined from this average clamp voltage.

Also, although the dielectric constant $\epsilon_a$ of the luminescent layer may be calculated from the capacitance measured by an LCR meter with only the luminescent layer sandwiched between electrodes, this dielectric constant can also be calculated from the Q–V characteristic of the electroluminescent element.

The inclination of the Q–V characteristic straight line in a range of from 0 V to the bent point means the total capacitance $C_t$ of the electroluminescent element from the relationship of Q=C·V and the inclination of the straight line from the bent point onward means the capacitance $C_i$ of the insulating layer. Also, in the electroluminescent element prior to clamp, the luminescent layer acts as a dielectric. Therefore, the insulating layer and the luminescent layer can be regarded as capacitors connected in series. Accordingly, the capacitance $C_z$ of the luminescent layer can be expressed by the equation (6) below.

$$C_z=C_i \cdot C_t/(C_i-C_t) \tag{6}$$

Also, the relationship between the capacitance $C_z$ and the dielectric constant $\epsilon_a$ of the luminescent layer is expressed by the equation (7) below.

$$C_z=\epsilon_0 \cdot \epsilon_a \cdot S/d_z \tag{7}$$

Accordingly, the dielectric constant $\epsilon_a$ of the luminescent layer can be determined using the equation (7).

The above-mentioned clamp electric field intensity can be varied according to the manufacturing conditions, etc. of the luminescent layer. The clamp electric field intensity is related to the crystallinity of the luminescent layer and decreases when the crystallinity thereof is improved.

Figure 30:
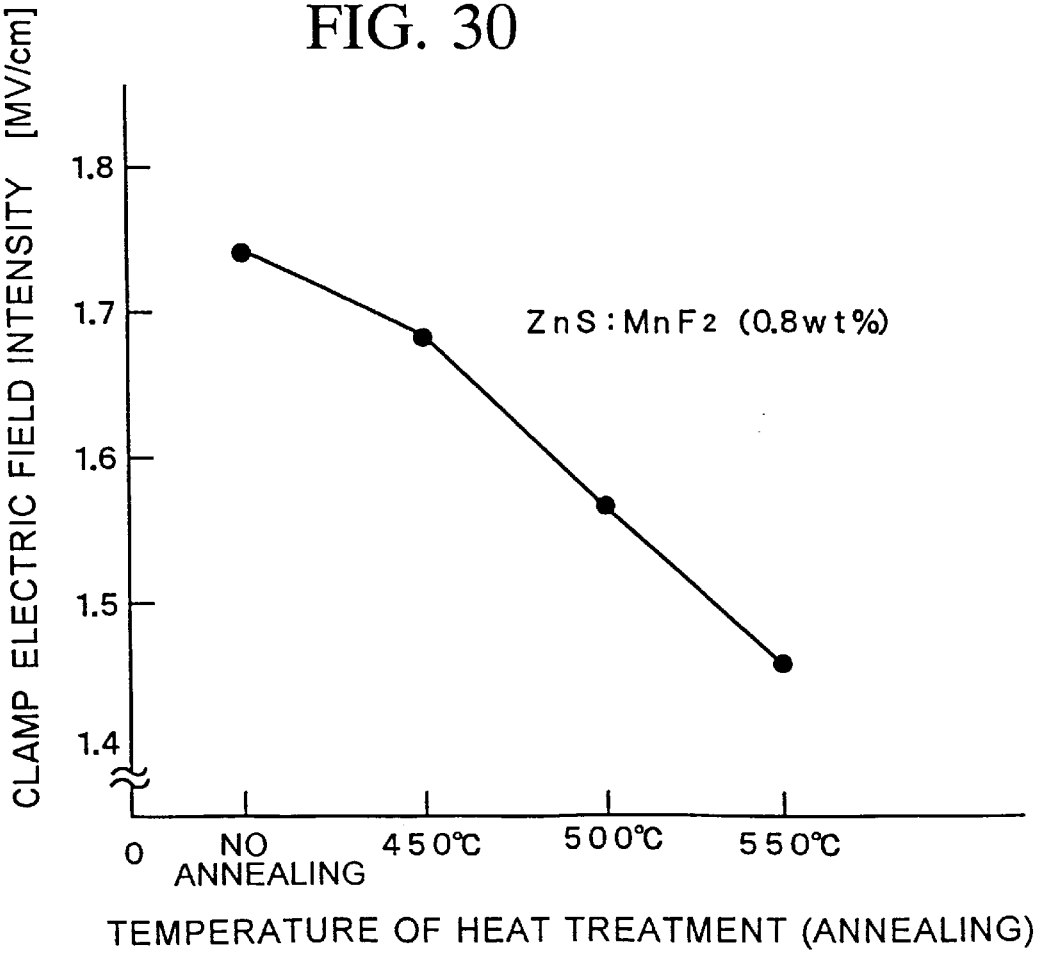
FIG. 30 is a graph illustrating a relationship between a heat-treatment (annealing) temperature and a clamp electric field intensity.
Figure 31:
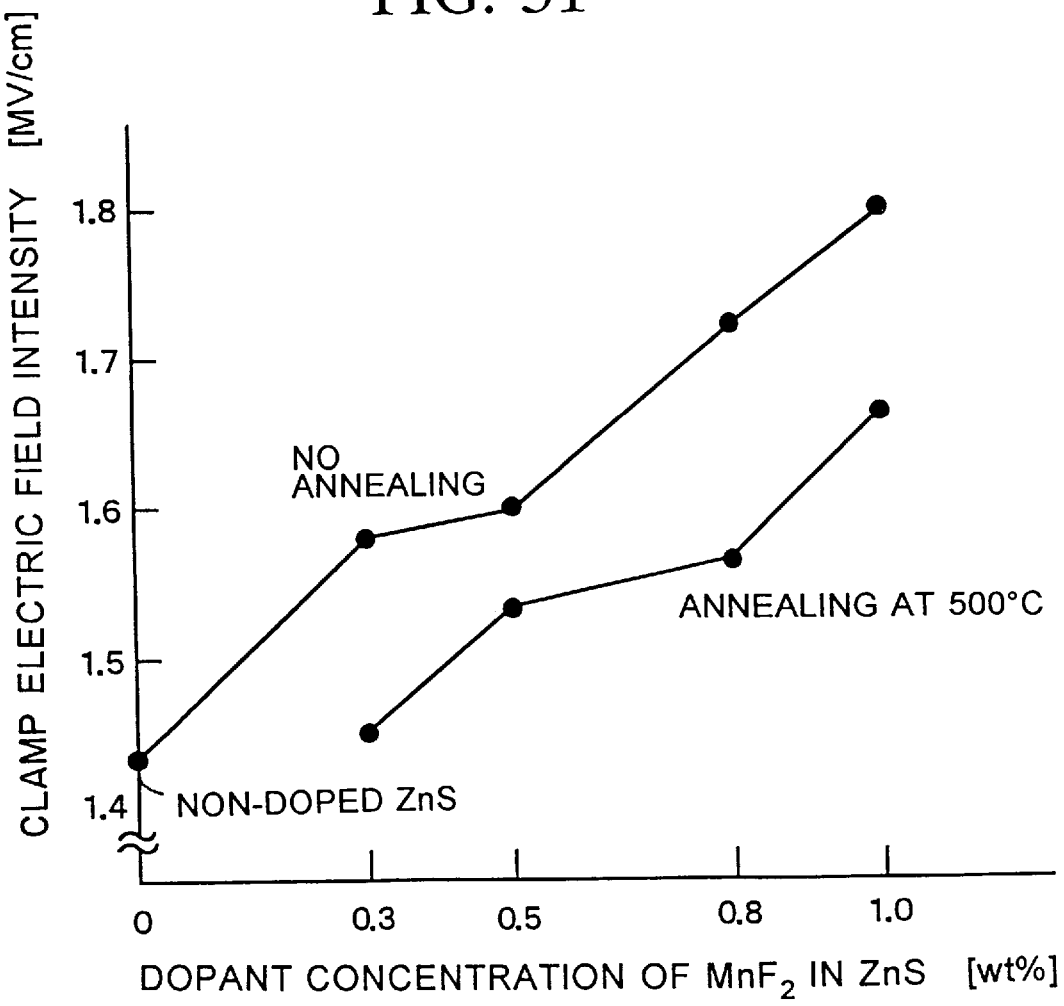
FIG. 31 is a graph illustrating a relationship between a doping concentration of a luminescent center and a clamp electric field intensity.
Figure 32:
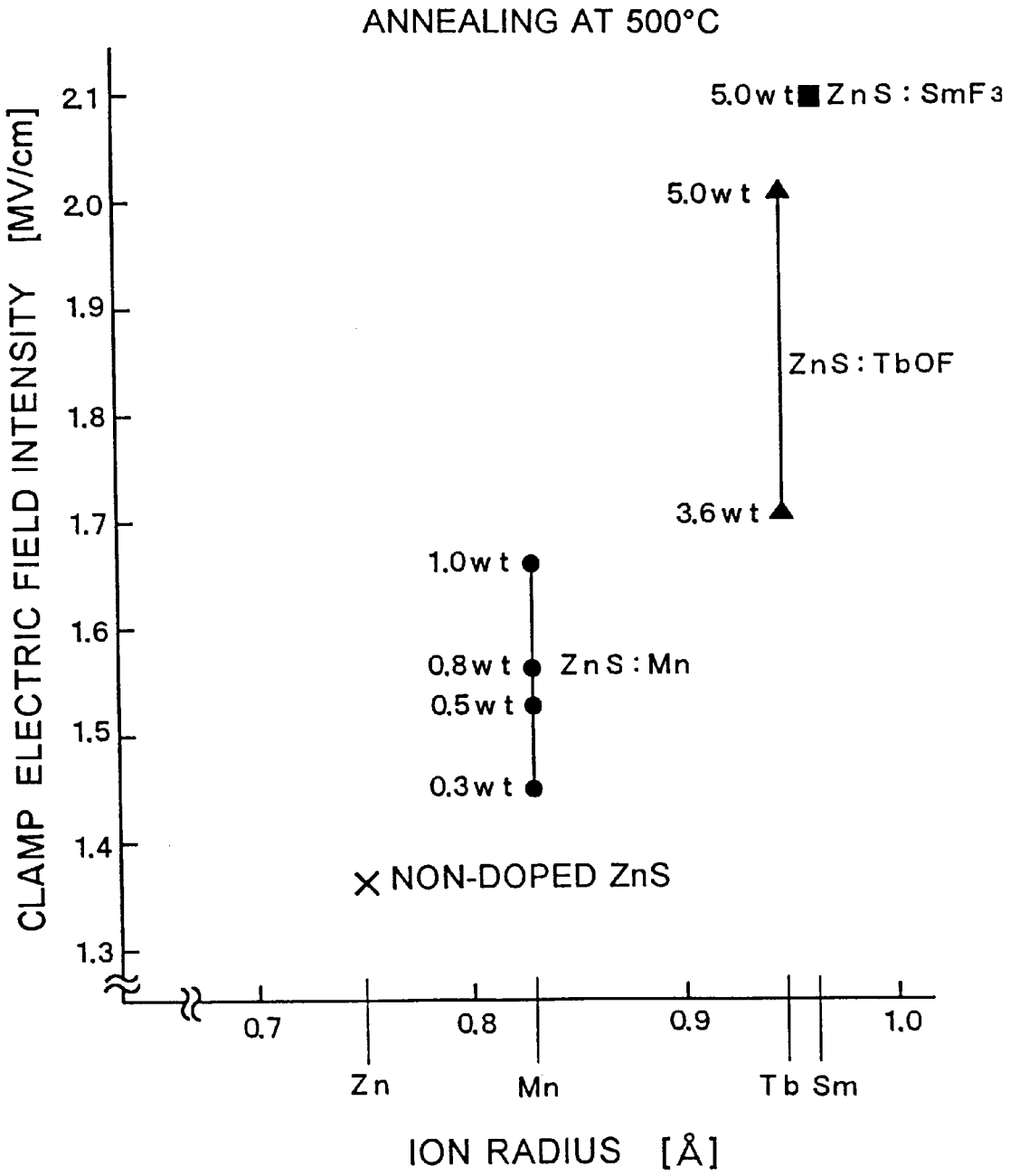
FIG. 32 is a graph illustrating a relationship between an ion radius of the luminescent center and a clamp electric field intensity.

For example, when the luminescent layer is heat treated (annealed), the clamp electric field intensity decreases while, on the other hand, when the dopant concentration of the luminescent center becomes high, the clamp electric field intensity increases. Also, in a case where the host material of each of the first and second luminescent layers is made to be a Group II–VIb compound semiconductor such as ZnS or a Group II–IIIb–VIb compound semiconductor, when a Group II element is substituted for by an element whose ion radius is large, the clamp electric field intensity increases. For example, since Tb is larger in ion radius than Mn, in a case where the host material is made to be ZnS, the resulting luminescent layer using Tb as the luminescent center becomes higher in clamp electric field intensity than the resulting luminescent layer using Mn as the luminescent center. FIGS. 30 to 32 illustrate states of variations in the clamp electric field intensity due to variations in the heat treatment (anneal) temperature, concentration of dopant as the luminescent center, and ion radius.

Also, separately from the crystallinity of the luminescent layer, the clamp electric field intensity varies due to the type of an interface of the luminescent layer as well. For example, the clamp electric field intensity at the interface between the luminescent layer and an insulating layer (dielectric layer) of SiN system is lower than that at the interface between the same luminescent layer and a high dielectric layer of $Ta_2O_5$ or $SrTiO_3$ system.

Note that the dielectric constant varies due to the concentration and the like of the additive used as the luminescent center.

As the above-mentioned electroluminescent element, a first luminescent layer can be constituted by a ZnS:Mn luminescent layer formed with the use of the evaporation method and a second luminescent layer can be constituted by a ZnS:Tb luminescent layer formed with the use of the sputtering method (refer to the first embodiment as described later).

Also, the first luminescent layer can be constituted by the ZnS:Tb luminescent layer formed with the use of the sputtering method and the second luminescent layer can be constituted by the ZnS:Mn luminescent layer formed with the use of the evaporation method (refer to the second embodiment as described later).

Figure 33:
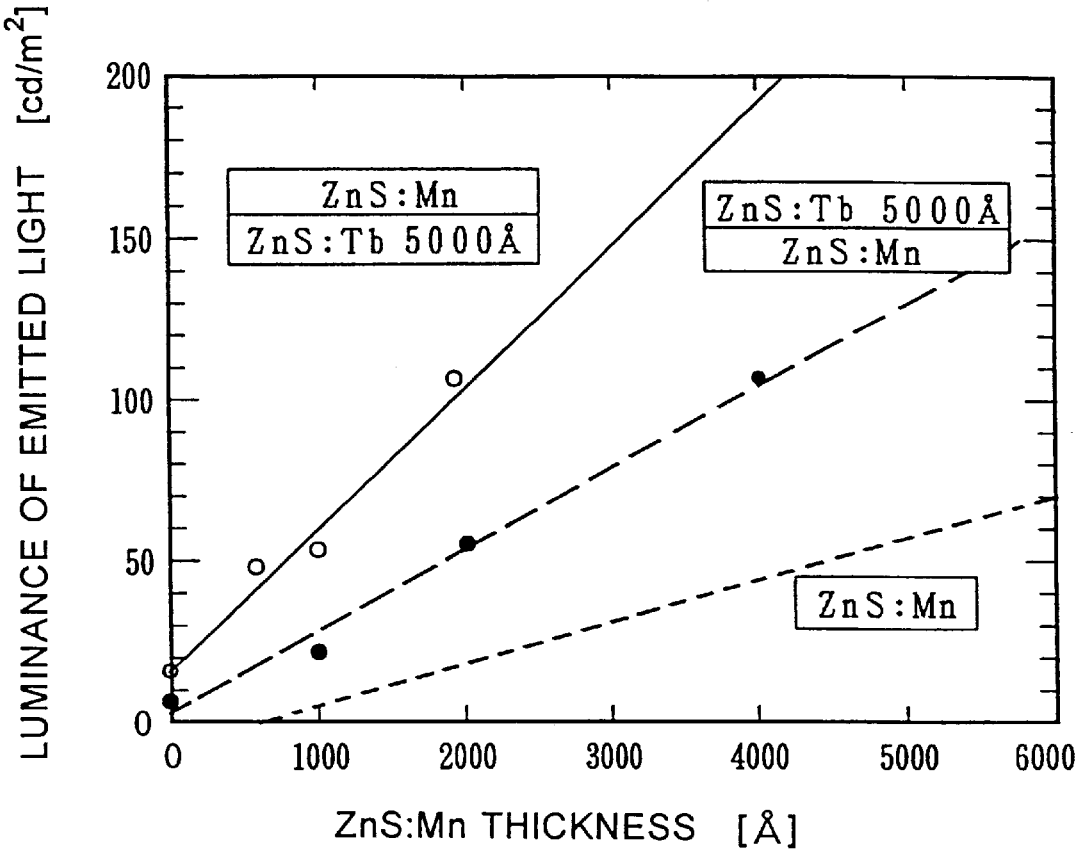
FIG. 33 is a characteristic diagram illustrating an emitted light luminance characteristic when the thickness of a ZnS:Mn layer is varied, regarding a single layer of ZnS:Mn, a laminate having a ZnS:Mn layer as its lower layer and a ZnS:Tb layer of 5,000 Å as its upper layer, and a laminate having a ZnS:Tb layer of 5,000 Å as its lower layer and a ZnS:Mn layer as its upper layer.

FIG. 33 illustrates the emitted light luminance characteristics of three luminescent layers when the thickness of the ZnS:Mn luminescent layer is varied, a first luminescent layer being one consisting of a single ZnS:Mn luminescent layer, a second luminescent layer being one consisting of a ZnS:Mn luminescent layer as a lower layer and a 5,000 Å ZnS:Tb luminescent layer stacked thereon as an upper layer, and a third luminescent layer being one consisting of a 5,000 Å ZnS:Tb luminescent layer as a lower layer and a ZnS:Mn luminescent layer stacked thereon as an upper layer.

When the luminescent layer of ZnS:Tb and the luminescent layer of ZnS:Mn are stacked one upon the other, there is an increase in the emitted light luminance compared to that in the case of the single ZnS:Mn luminescent layer. In other words, the emitted light luminance per unit thickness of the ZnS:Mn luminescent layer increases. The emitted light luminance per unit thickness thereof becomes higher when the ZnS:Mn luminescent layer is stacked on the ZnS:Tb luminescent layer from above than when it is stacked thereon from below. The reason for this is that when the second luminescent layer (ZnS:Mn) is formed by evaporation from above onto the first luminescent layer (ZnS:Tb) formed by sputtering, the dead layer of the second luminescent layer decreases with the result that the crystallinity thereof has increased.

A first aspect of the present invention has been achieved on the basis of the above-mentioned various studies on the matter and is characterized in that the luminescent layer and the compound semiconductor layer are disposed in a stacked relation and the compound semiconductor layer is selected to have a clamp electric field intensity higher than that of the luminescent layer.

As a result of this, electric charge having high acceleration energy is injected from the compound semiconductor layer high in clamp electric field intensity into the luminescent layer, thereby enabling an increase in the luminance of the luminescent layer.

Also, if the luminescent layer and the compound semiconductor layer are constituted by the same host material, the interface therebetween can be made to have continuity to thereby facilitate injection of electric charge and increase the luminance of the luminescent layer.

In this case, if the compound semiconductor layer is disposed on a side of the luminescent layer near to the substrate adjacently thereto, the crystallinity of the luminescent layer is improved, thereby enabling a further increase in the luminance of the luminescent layer.

Regarding the compound semiconductor layer, at least one selected from the group consisting of Group II–VIb and Group II–IIIb–VIb compound semiconductors can be used as a main component thereof. In this case, the compound semiconductor layer can be made to contain as an additive an element capable of being substituted for a Group II element of the compound semiconductor.

Also, by the luminescent center of the luminescent layer containing a first element capable of being substituted for a Group II element and by the compound semiconductor layer containing as an additive a second element capable of being substituted for a Group II element and by making the ion radius of the second element larger than that of the first element, it is possible to increase the clamp electric field intensity of the compound semiconductor layer.

Also, if the compound semiconductor layer is made to be one in which no electroluminescence in a range of visible light occurs, it is possible to obtain a single color light of high luminance from the luminescent layer alone.

Also, if the compound semiconductor layer is made to be one in which electroluminescence similar to that occurring in the luminescent layer occurs, it is possible to improve the color purity.

Further, in a second aspect of the present invention, characteristically, the luminescent layer and the compound semiconductor layer are disposed in a stacked relation, the compound semiconductor layer is selected to have a clamp electric field intensity higher than that of the luminescent layer, while the product of the dielectric constant and clamp electric field intensity of the luminescent layer is larger than the product of the dielectric constant and clamp electric field intensity of the compound semiconductor layer.

As a result of this, it is possible to decrease the luminescence threshold voltage of the luminescent layer as mentioned above.

According to a third aspect of the present invention, the first and second luminescent layers are made up into a stacked structure and the second luminescent layer is made higher in clamp electric field intensity than the first luminescent layer and the product of the dielectric constant and clamp electric field intensity of the first luminescent layer is made to be larger than the product of the dielectric constant and clamp electric field intensity of the second luminescent layer. As a result of this, it is possible to increase any desired one of the first and second luminescent layers and, by causing simultaneous emission thereof, decrease the luminescence threshold voltage at stacked portions thereof.

By the luminescent center of the first luminescent layer containing a first element capable of being substituted for a Group II element of the host material and by the luminescent center of the second luminescent layer containing a second element capable of being substituted for a Group II element of the host material and making the ion radius of the second element larger than that of the first element, it is possible to make the clamp electric field intensity of the second luminescent layer higher than that of the first luminescent layer.

Specifically, in a case where the first luminescent layer is made of a material of ZnS containing Mn and the second luminescent layer is made of a material of ZnS containing Tb, the first luminescent layer can be set such that the clamp electric field intensity is in a range of from 1.4 MV/cm to 1.7 MV/cm and the dielectric constant is in a range of from 10 to 12 while, on the other hand, the second luminescent layer can be set such that the clamp electric field intensity is in a range of from 1.8 MV/cm to 2.1 MV/cm and the dielectric constant is in a range of from 8 to 10.

Also, in a case where the first luminescent layer is made of a material of ZnS containing Tb and the second luminescent layer is made of a material of ZnS containing Mn, the first luminescent layer can be set such that the clamp electric field intensity is in a range of from 1.8 MV/cm to 2.1 MV/cm and the dielectric constant is in a range of from 8 to 10 while, on the other hand, the second luminescent layer can be set such that the clamp electric field intensity is in a range of from 1.4 MV/cm to 1.7 MV/cm and the dielectric constant is in a range of from 10 to 12.

Further, in a fourth aspect of the present invention, characteristically, a luminescent layer structure composed of the first luminescent layer and the second luminescent layer consists of a stacked portion wherein the first and second luminescent layers are stacked and a single layer portion which consists of the second luminescent layer alone. Further, the second luminescent layer and the first luminescent layer are selected so that they have clamp electric field intensities which differ from each other, and that the product of the dielectric constant and clamp electric field intensity of the luminescent layer lower in clamp electric field intensity is larger than the product of the dielectric constant and clamp electric field intensity of the luminescent layer higher in clamp electric field intensity.

When the luminescent layer structure is made to have the above-mentioned two stacked layer structure, it is possible to decrease the luminescence threshold voltage at stacked portions of the two luminescent layers by causing simultaneous emission thereof as well as to increase the luminance of any desired one thereof. As a result of this, it becomes possible to substantially equalize the luminescence threshold voltage at stacked portions with that at single layer portions.

Specifically, the first luminescent layer can be made of a material of ZnS containing Mn and the second luminescent layer can be made of a material of ZnS containing Tb.

In this case, by making the thickness of the second luminescent layer at stacked portions equal to that at single layer portions and by, when making the thickness of the first luminescent layer to be 1, making the thickness of the second luminescent layer existing on the first luminescent layer to be from 1.5 to 5.0 inclusive, it is possible to make the luminescence threshold voltage at stacked portions substantially equal to that at single layer portions. In this case, it is preferable that the thickness of the first luminescent layer be in a range of from 1,000 Å to 3,500 Å.

Also, since the luminescence threshold voltage of the first luminescent layer at stacked portions can be further decreased by decreasing the thickness of the second luminescent layer at stacked portions, it is possible to increase the thickness of the first luminescent layer at stacked portions and thereby further increase the emitted light luminance of the first luminescent layer.

Also, by forming a red color filter on the second electrode in correspondence with a region where the first luminescent layer is formed, it is possible to make red the color of light emitted from stacked portions.

Also, by constructing the first and second electrodes in a large number of stripes (lines) intersecting each other at a right angle with one thereof being set to be column electrodes and the other thereof being set to be row electrodes, it is possible to make dot-matrix display. Here, the column electrodes and row electrodes correspond to driver circuits connected thereto, respectively. Specifically, the column electrodes are data electrodes connected to a data side driver circuit, and the row electrodes are defined as scanning electrodes connected to a scanning side driver circuit. In this case, each first luminescent layer, which forms each stacked portion, can be shaped in a stripe-like configuration and disposed so that the longitudinal direction thereof extends along by a corresponding column electrode, and the dot-matrix type display panel can be so composed that, in the luminescent layer structure, the stacked portion and the single layer portion are arranged alternately to be along by the corresponding column electrode and neighboring another column electrode.

In this case, if, concerning the stripe width W of each stripe-shaped first luminescent layer, the line width $W_1$ of the column electrode and the interval $W_2$ between the column electrode lines, a relation of $W_1 \leqq W < W_1 + 2 \times W_2$ is made to be established, it becomes possible to make separation between the red color and the green color, thereby improving the color purity of the emitted light.

Also, if the line width of the column electrode and the line width of the column electrode adjacent thereto are arranged so that the ratio of the luminance of light having transmitted through the red filter to the luminance of the second luminescent layer may be approximately 1:2, it is possible to obtain a ratio of luminance between red and green which is the case with natural light.

Further, in a fifth aspect of the present invention, characteristically, a luminescent layer structure composed of the first luminescent layer and the second luminescent layer consists of a stacked portion wherein the first and second luminescent layers are stacked and a single layer portion which consists of the first luminescent layer alone. Further the second luminescent layer and the first luminescent layer are selected so that they have clamp electric field intensities which differ from each other, and that the product of the dielectric constant and clamp electric field intensity of the luminescent layer lower in clamp electric field intensity is larger than the product of the dielectric constant and clamp electric field intensity of the luminescent layer higher in clamp electric field intensity.

When the luminescent layer structure is made to have the above-mentioned two stacked layer structure, it is possible to decrease the luminescence threshold voltage at stacked portions of the two luminescent layers by causing simultaneous emission thereof as well as to increase the luminance of any desired one thereof, thereby enabling substantial equalization of the luminescence threshold voltage at stacked portions with that at single layer portions, like the above mentioned fourth aspect of the present invention.

In this case, by forming the first luminescent layer by sputtering and forming the second luminescent layer on the first luminescent layer by evaporation, the dead layer in the second luminescent layer is decreased with the result that the crystallinity thereof is increased, which results in the light emission efficiency being improved. This enables an increase in the luminance of light emitted from the second luminescent layer.

A material of ZnS containing Tb can be used as the material of the first luminescent layer while, on the other hand, a material of ZnS containing Mn can be used as the material of the second luminescent layer.

In this case, by making the thickness of the first luminescent layer at stacked portions equal to the thickness thereof at single layer portions and making the thickness of the second luminescent layer to range from 1,000 Å to 3,500 Å inclusive, it is possible to substantially equalize the luminescence threshold voltage at stacked portions with that at single layer portions.

Also, since the luminescence threshold voltage of the first luminescent layer at stacked portions can be further decreased by decreasing the thickness of the first luminescent layer at stacked portions, it is possible to increase the thickness of the second luminescent layer at stacked portions to thereby enable a further increase in the luminance of light emitted from the second luminescent layer.

Also, by forming a red color filter on the second electrode in correspondence with a region where the second luminescent layer is formed, it is possible to make light from stacked portions red.

In this case, if the column electrodes are divided into the column electrodes corresponding to the stacked portions and the column electrodes corresponding to the single layer portions and the red color filter is formed so that the widthwise edge thereof may be located at the widthwise end of the column electrode corresponding to the single layer portion, it is possible to prevent light rays from leaking through a gap between the red color filter and the column electrode and decreasing in color purity.

As the above-mentioned red color filter used in the fourth and fifth aspects, there can be used a long pass filter permitting the passage therethrough of light having a wavelength of 590 nm or more and interrupting the passage therethrough of light having a wavelength of less than 590 nm. By using this type of filter, it is possible to interrupt the passage therethrough of light having a peak wavelength of 580 nm in the spectrum of light from the first luminescent layer to thereby improve a red color purity.

In this case, if the first electrode consists of a reflective metal film, it is possible to increase the luminance of the emitted light. Also, if a black color layer is formed on a rear side of the first electrode, it is possible to eliminate a feeling of existence of the red color filter on a front side thereof and make it easier to recognize the display.

Furthermore, if there is constructed an electroluminescent element structure wherein the above- mentioned electroluminescent element arranged to emit red and green color lights is used as a rear element and an electroluminescent element arranged to emit blue color light is used as a front element, it is possible to make a multicolor display. Furthermore, it is possible to make a full color display.

The present invention will be explained on the basis of specific embodiments illustrated in the figures.

(First Embodiment)

Figure 1:
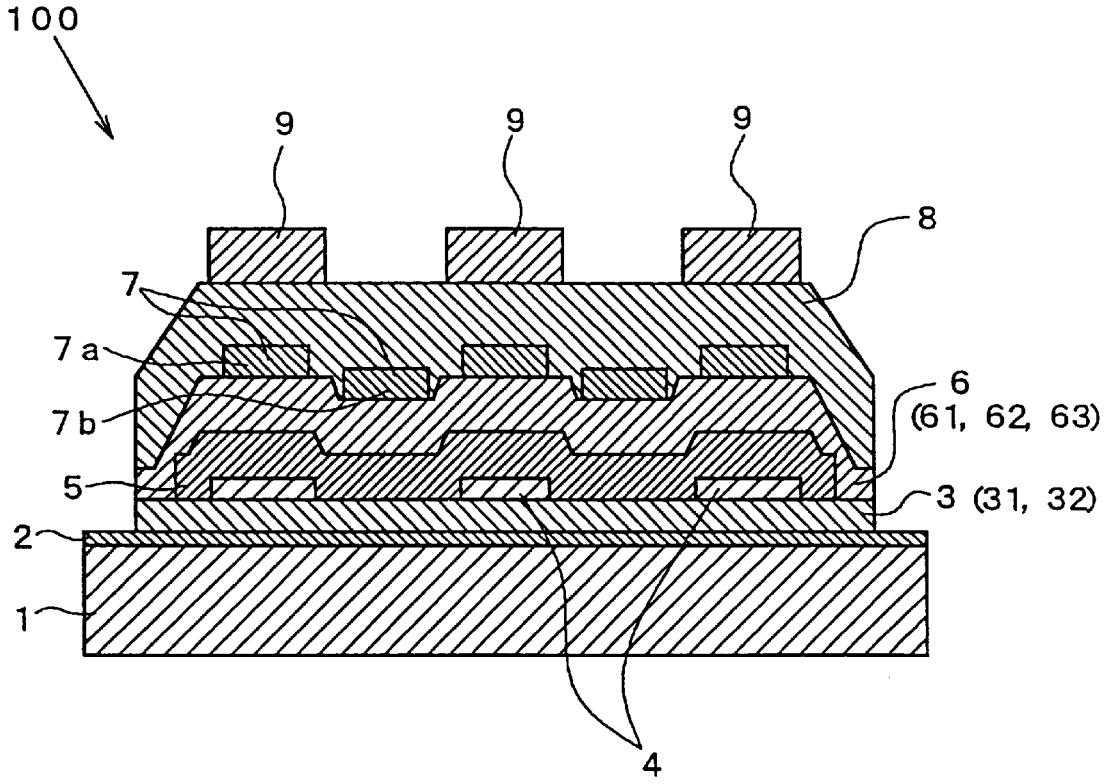
FIG. 1 is a schematic sectional view illustrating the construction of an electroluminescent element of a first embodiment of the present invention.
Figure 2:
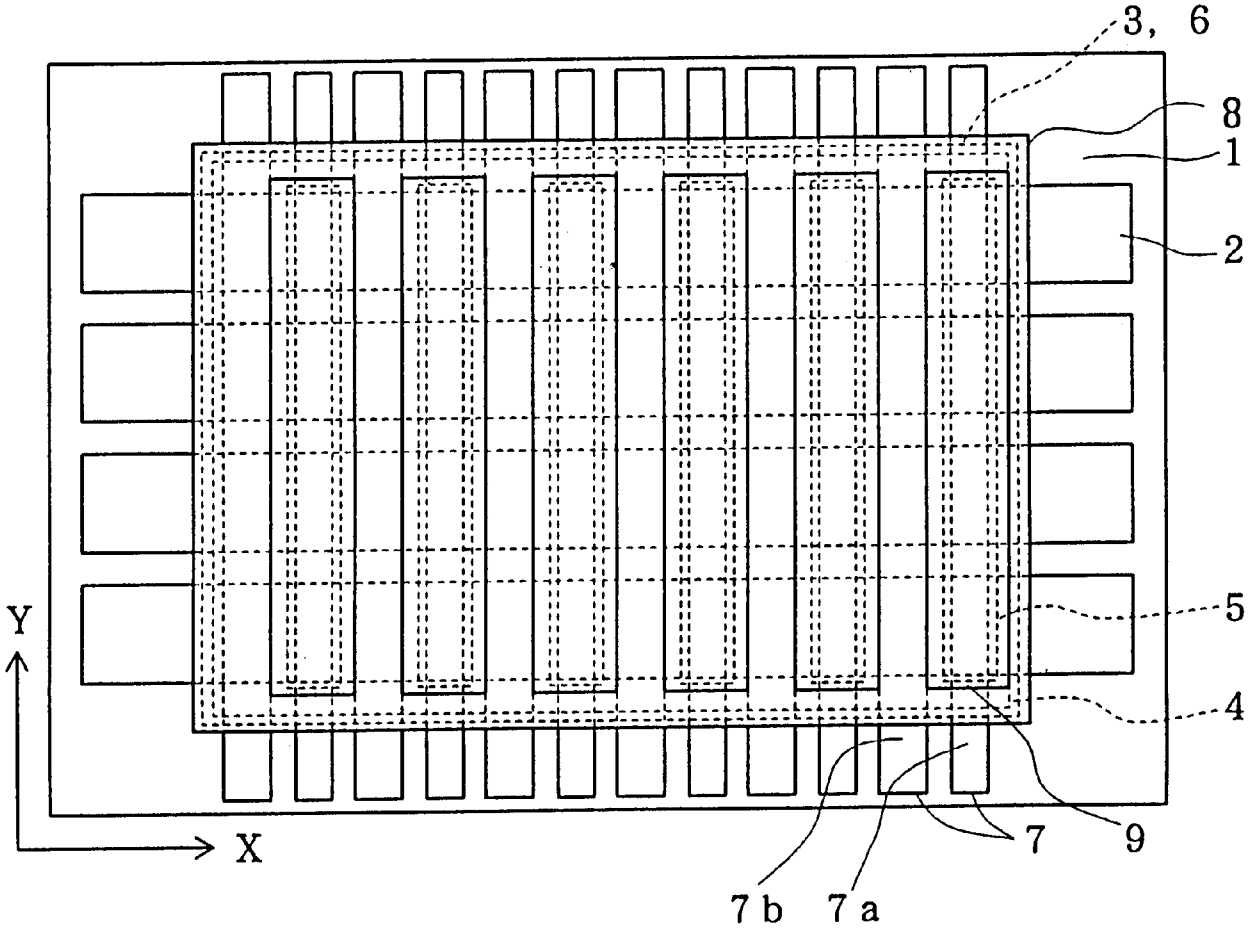
FIG. 2 is a plan view illustrating the arrangement of the first and second electrodes of the electroluminescent element in the first embodiment of the present invention.

FIG. 1 is a typical view illustrating a longitudinal section of an electroluminescent element in a first embodiment of the present invention, and FIG. 2 is a plan view thereof.

An electroluminescent element 100 is constructed such that the following thin films are sequentially stacked on a glass substrate 1 which is an insulating substrate. A first electrode 2 consisting of a reflective metal film of Ta (tantalum) and having a thickness of 2,000 Å (row electrodes, i.e., operating side electrodes at a time of matrix driving). As illustrated in FIG. 2, the first electrode 2 is disposed such that a plurality of stripes extending in the x-axis direction are arranged in large number in the y-axis direction.

A first insulating layer 3 is uniformly formed on the glass substrate 1 having the first electrode 2 formed thereon. The first insulating layer 3 is composed of two layers, one of which is a first lower insulating layer 31 consisting of an optically transparent $SiO_xN_y$ (silicon oxynitride) and having a thickness of 500 to 1,000 Å and the other of which is a first upper insulating layer 32 consisting of a composite film $Ta_2O_5$:$Al_2O_3$ of $Ta_2O_5$ (tantalum pentaoxide) and $Al_2O_3$ (aluminum oxide).

A first luminescent layer 4 having a thickness of 2,000 Å is formed on the first upper insulating layer 32. As illustrated in FIG. 2, the first luminescent layer 4 is disposed such that a plurality of stripes extending in the y-axis direction are arranged in large number at prescribed intervals in the x-axis direction.

The first luminescent layer 4 is made of a material of ZnS having Mn added thereto. On the first luminescent layer 4 and first upper insulating layer 32 there is formed a second luminescent layer 5 having a thickness of 5,000 Å in such a manner as to cover an entire surface thereof. The second luminescent layer 5 is made of a material of TbOF (terbium oxyfluoride).

A second insulating layer 6 is formed on the second luminescent layer 5 in such a manner as to cover an entire surface thereof. The second insulating layer 6 is composed of three layers, a first one of which is a second lower insulating layer 61 consisting of an optically transparent $Si_3N_4$ (silicon nitride) and having a thickness of 1,000 Å, a second one of which is a second intermediate insulating layer 62 consisting of a composite film of $Ta_2O_5$:$Al_2O_3$ and having a thickness of 2,000 Å, and a third one of which is a second upper insulating layer 63 consisting of $SiO_xN_y$ and having a thickness of 1,000 Å.

On the second upper insulating layer 63 there is formed a second electrode (column electrode, i.e., signal electrode) 7 consisting of an optically transparent ZnO (zinc oxide) and $Ga_2O_3$ (gallium oxide) and having a thickness of 4,500 Å. As illustrated in FIG. 2, the second electrode 7 is disposed such that a plurality of stripes extending in the y-axis direction are arranged in large number in the x-axis direction.

A protective film 8 made of resin and having a thickness of 0.8 to 1.5 $\mu$m is formed on the second electrode 7. A red color filter 9 made of resin and having a thickness of 1.5 to 2.0 $\mu$m is formed on a portion of this protective film 8 under which the first luminescent layer 4 exists. As illustrated in FIG. 2, the red color filter 9 is a stripe which is formed on the second electrode 7 from above in such a manner as to cover the same and extends in the y-axis direction. It transmits light emitted from a stacked portion of the first luminescent layer 4 and the second luminescent layer 5.

Next, a method for manufacturing the above-mentioned electroluminescent element 100 will be explained. FIGS. 3A to 3D and FIGS. 4A to 4C are plan views illustrating this manufacturing method.

Figure 3A:
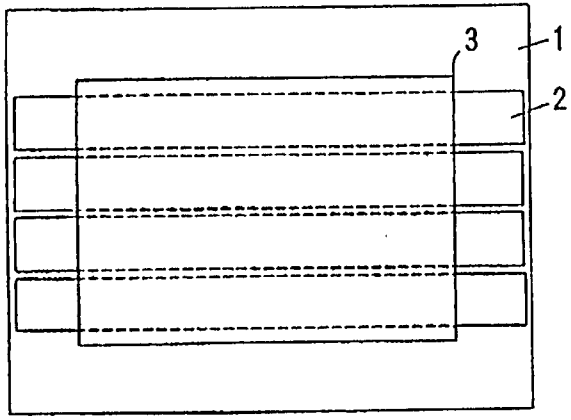
FIGS. 3A to 3D are plan views illustrating a method for manufacturing the electroluminescent element of the first embodiment.
Figure 3B:
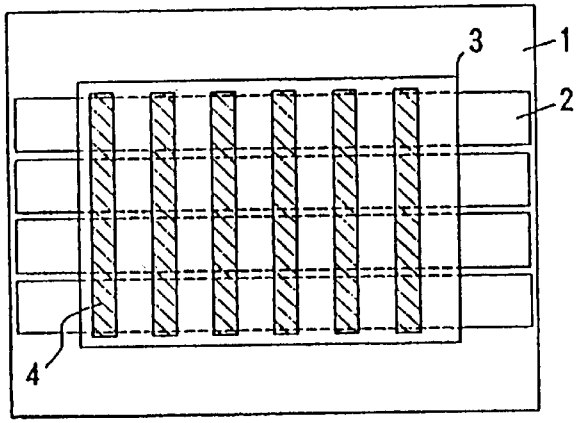

DC diode sputtering of Ta metal is performed on the glass substrate 1 and thereafter, as illustrated in FIG. 3A, the resulting metal film is etched in stripes to thereby form the first electrode 2 consisting of a metallic reflection film.

Next, the first lower insulating layer 31 consisting of $SiO_xN_y$ and the first upper insulating layer 32 consisting of a material of $Ta_2O_5$ containing 6 wt % of $Al_2O_3$ are formed by sputtering. Specifically, the glass substrate 1 is maintained at a temperature of 300° C., a gaseous mixture of Ar (argon), $N_2$ (nitrogen) and a small amount of $O_2$ (oxygen) are introduced into a sputtering device, the gaseous pressure is maintained at a level of 0.5 Pa, and a film of $SiO_xN_y$ is formed with a high frequency power of 3 KW by using silicon as a target. Subsequently, a composite film of $Ta_2O_5$:$Al_2O_3$ is formed by using Ar and $O_2$ as sputter gases with the gaseous pressure being maintained at a level of 0.6 Pa and by using as a target a sintered mixture of $Ta_2O_5$ and 6 wt % of $Al_2O_3$ contained therein under a condition of 4 KW high frequency power.

Next, a layer made of a material of ZnS:Mn in which ZnS is a host material and Mn is added thereto as a luminescent center is uniformly formed by evaporation on the first upper insulating layer 32. Specifically, the glass substrate 1 is maintained at a constant temperature, and the interior of the evaporation device is maintained at a pressure level of $5\times10^{-4}$ Pa or less, whereby electron beam evaporation is performed at a deposition rate of 0.1 to 0.3 nm/sec. Next, this layer is etched in a form illustrated in FIG. 3B, thereby the first luminescent layer 4 is obtained.

Figure 3C:
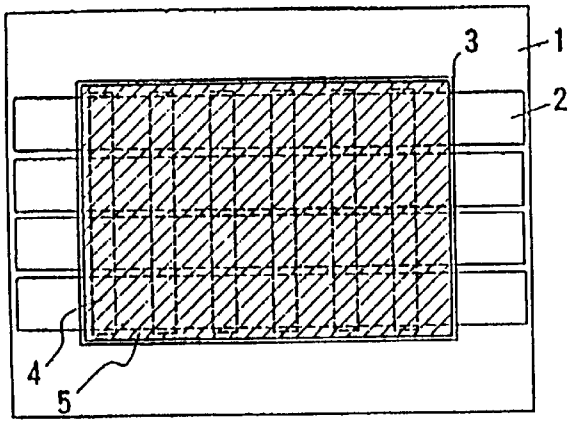

Next, as illustrated in FIG. 3C, the second luminescent layer 5 consisting of a material of ZnS:TbOF in which ZnS is a host material and TbOF is added thereto as a luminescent center is formed over the first luminescent layer 4 and exposed surfaces of the first insulating layer 3. Specifically, sputtering is performed to form a film under conditions wherein the glass substrate 1 is maintained at a temperature of 250° C.; Ar and He (helium) are used as sputter gases; the gaseous pressure is 3.0 Pa; and the high frequency power is 2.2 KW. Thereafter, the luminescent layers 4 and 5 are heat treated in vacuum at 400 to 600° C.

Figure 3D:
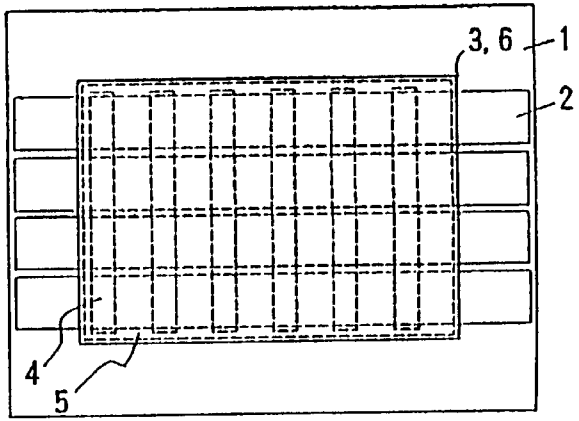

Next, as illustrated in FIG. 3D, on the first luminescent layer 4 and the second luminescent layer 5 there are formed (as in the case of the first insulating layer 3 being formed) the second lower insulating layer 61 consisting of a material of $Si_3N_4$, the second intermediate insulating layer 62 consisting of a material of $Ta_2O_5$ containing 6 wt % of $Al_2O_3$, and the second upper insulating layer 63 consisting of a material of $SiO_xN_y$. Note, however, that the $Si_3N_4$ film is formed without introducing $O_2$ as sputter gas, unlike the $SiO_xN_y$.

Next, a layer made of a material of ZnO:$Ga_2O_3$ is uniformly formed on the second upper insulating layer 63. The evaporation material used is prepared by adding a material of $Ga_2O_3$ to a ZnO powder and forming the resulting mass into a configuration of pellets, and an ion plating device was used as a film former. Specifically, after exhausting the interior of the ion plating device into vacuum with the temperature of the glass substrate 1 being maintained at a prescribed constant value, Ar (argon) gas is introduced and the gaseous pressure is maintained at a prescribed constant value, whereupon the electron beam power and the high frequency power are adjusted so that the film forming rate may be in a range of from 6 to 18 nm/min to thereby perform film formation. Next, this film is etched in such a pattern as illustrated in FIG. 4A, thereby the second electrode 7 is obtained.

Figure 4B:
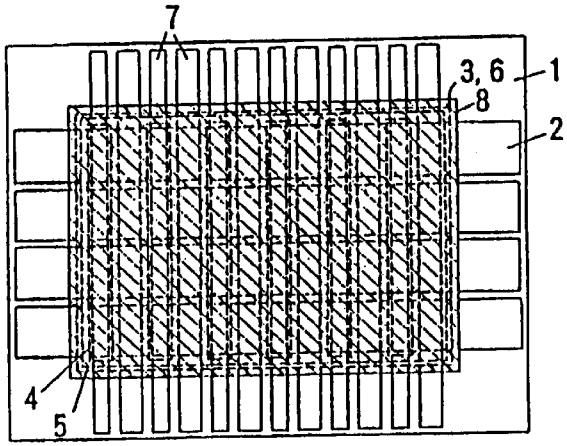
FIGS. 4A to 4C are plan views illustrating the method for manufacturing the electroluminescent element which succeeds FIG. 3D.
Figure 4A:
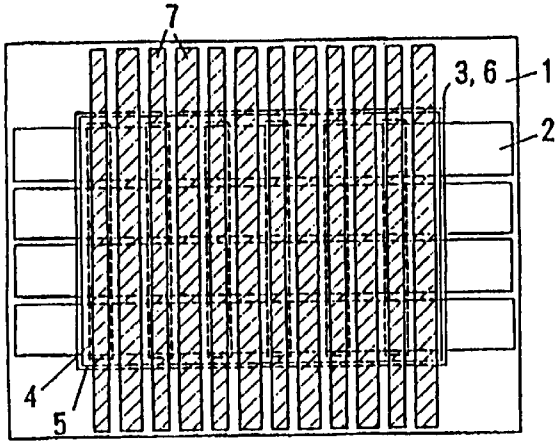

Next, as illustrated in FIG. 4B, resin is coated onto the second electrode 7 and exposed surfaces of the second insulating layer 6 in such a manner as to entirely cover the same except for respective electrode take-out portions of the first electrode 2 and the second electrode 7 to thereby form the protective film 8.

Figure 4C:
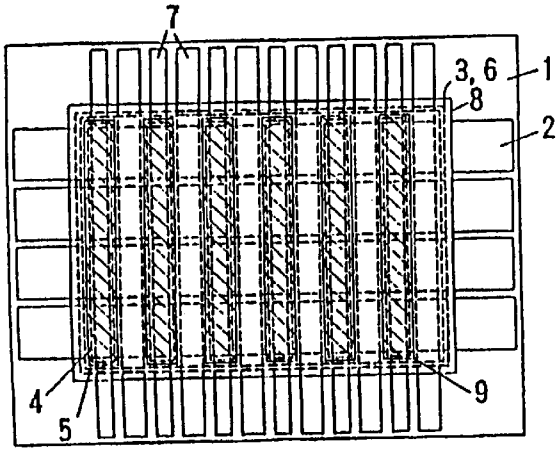

The red color film 9 of organic dye dispersed type is formed on this protective film 8. Specifically, photoresist containing red color organic dye is dropped in prescribed quantity onto the protective film 8, whereupon resist coating is performed for several seconds with the use of a spinner. Thereafter, as illustrated in FIG. 4C, exposure and development are performed using the same pattern as in the case of the first luminescent layer 4, whereupon post baking is performed, thereby forming the red color filter 9. The width of the red color filter 9 is made to be one the same as the width of the first luminescent layer 4.

Figure 5:
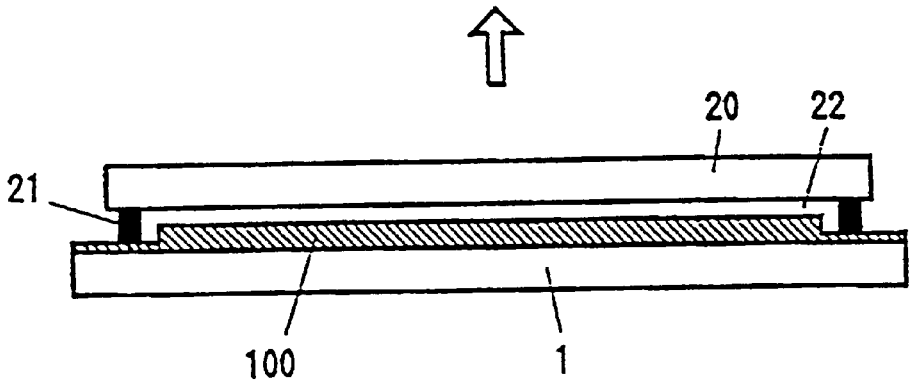
FIG. 5 is a sectional view illustrating a structure wherein the electroluminescent element of the first embodiment is assembled.

As illustrated in FIG. 5, the glass substrate 1 of the electroluminescent element 100 thus formed is bonded to a front glass substrate 2 by means of a frame body 21 and silicon oil 22 is injected under vacuum into the interior of the resulting structure for preventing moisture absorption.

In the above-mentioned construction, the first luminescent layer 4 emits yellowish orange color light and the second luminescent layer 5 emits green color light. The lights emitted from the first luminescent layer 4 and the second luminescent layer 5 transmit through the red color filter 9, whereby red color light having a high color purity is obtained from the red color filter 9. Note that when a red color filter permitting the passage therethrough of light having a wavelength of, for example, 590 nm or more is used, the light which transmits therethrough is substantially only light radiated from the first luminescent layer 4.

When measured from the Q–V characteristic (electric charge vs voltage) of the electroluminescent element, the first luminescent layer consisting of ZnS:Mn in this embodiment is such that the clamp electric field intensity is in a range of from 1.4 MV/cm to 1.7 MV/cm and the dielectric constant ea is in a range of from 10 to 12. Also, the second luminescent layer consisting of ZnS:TbOF is such that the clamp electric field intensity is in a range of from 1.8 MV/cm to 2.1 MV/cm and the dielectric constant $\epsilon_a$ is in a range of from 8 to 10. The clamp electric field intensity of the second luminescent layer 5 is higher than that of the first luminescent layer 4 and the product of the dielectric constant and clamp electric field intensity of the first luminescent layer 4 is larger than the product of the dielectric constant and clamp electric field intensity of the second luminescent layer 5. As a result of this, it is possible to increase the luminance of light emitted from the first luminescent layer 4 and decrease the luminescence threshold voltage.

At this time, by making the thickness of the second luminescent layer 5 to be 1.5 times or more as large as that of the first luminescent layer 4, it is possible to substantially equalize the luminescence threshold voltage of a stacked portion of the first luminescent layer 4 and the second luminescent layer 5 with that of a single layer portion of the second luminescent layer 5. Also, by making the thickness of the second luminescent layer 5 to be 5.0 times or less as large as that of the first luminescent layer 4, it is possible to maintain a balance in luminance between the green color and the red color.

Also, by making the thickness of the first luminescent layer 4 to be 1,000 Å or more, it is possible to obtain a required luminance of the emitted red color light. Also, by making this thickness to be 3,500 Å or less, it is possible to cause the luminescence threshold voltage of the electroluminescent element to fall under a prescribed range. Further, it is possible to operate the electroluminescent element with a drive voltage falling within a limit of the withstand voltage of peripheral parts such as a driver IC, etc.

Also, green color emitted light is obtained from an overlapped portion of the second electrode 7 upon a single layer portion of the second luminescent layer 5. This green color emitted light is transmitted through no filter and therefore has a high luminance with the green color purity not being impaired.

Figure 6:
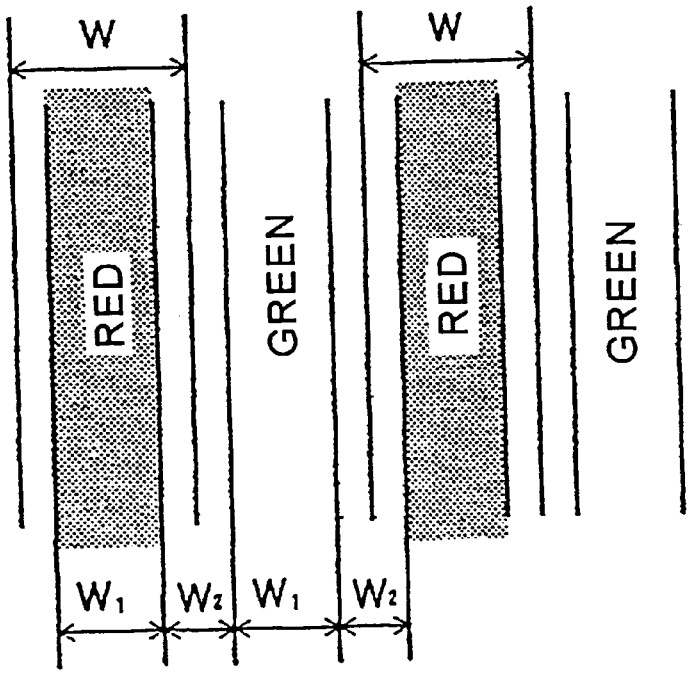
FIG. 6 is a view illustrating a relationship between the width of a first luminescent layer of the electroluminescent element of the first embodiment and the width of a second electrode and the space interval between the second electrodes.

As illustrated in FIG. 6, among the stripe width W of the first luminescent layer 4, the stripe width $W_1$ of the second electrode 7 formed above the first luminescent layer 4, and the stripe interval $W_2$ of the second electrode 7, a relation of $W=W_1+W_2$ is established. Owing to this relation, the width of the first luminescent layer 4 is wider than the width of the second electrode 7*a* for causing emission of red color light and the first luminescent layer 4 does not exist under the second electrode 7*b* for causing emission of green color light. That is, the border line of the first luminescent layer 4 exists between the second electrode 7*a* and the second electrode 7*b*, with the result that mixing of red color emitted light and green color emitted light is prevented. In order to prevent mixing of the colors of lights, it is sufficient that the border line of the luminescent layer 4 exists between the second electrode 7*a* and the second electrode 7*b*. The condition for this is that a relation of $W_1 \leqq W < W_1+2\times W_2$ is established. In this embodiment, the electroluminescent element was prepared as one which satisfied the relation of $W=W_1+W_2$.

Also, in the above-mentioned embodiment, the first electrode 2 is used as a horizontal scan electrode and the second electrode 7 is used as a vertical signal electrode. Since the first electrode 2 is formed of a metal of Ta, the resistivity thereof is lower than that of the second electrode 7. Accordingly, since the potential of the first electrode 2 as viewed in the lengthwise direction thereof can be made uniform, it is possible to prevent uneven emission of light.

Although, in this embodiment, the first electrode 2 has been formed of metal of Ta, it may be formed of metal such as Al (aluminum), Ag (silver), Mo (molybdenum), W (tungsten) or the like. Also, an auxiliary metal electrode for making the first electrode low in resistance may be added as the necessity arises.

Note that the second electrode can be also patterned as follows.

Figure 7:
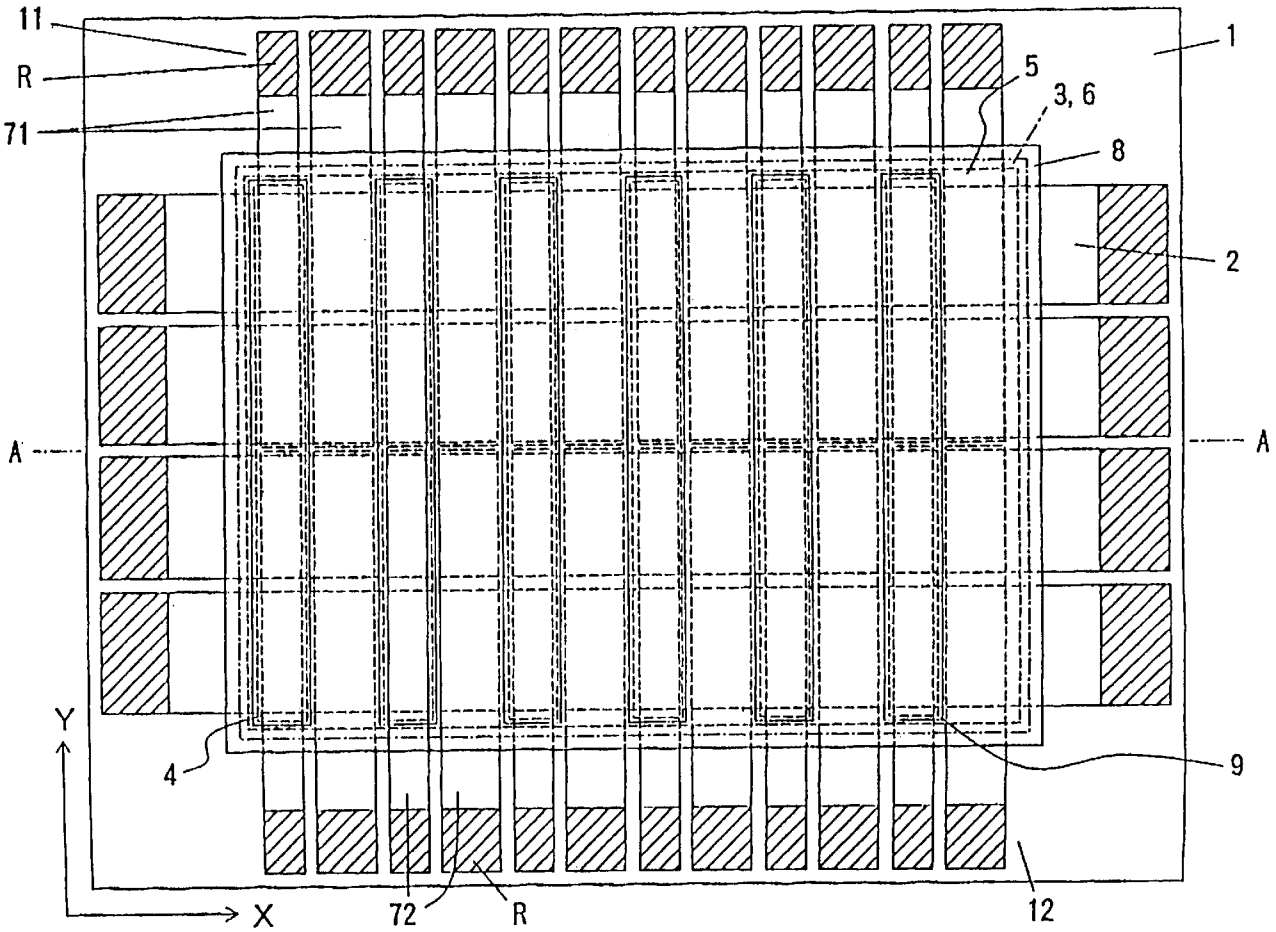
FIG. 7 is a plan view illustrating another example of the arrangement of the first and second electrodes of the electroluminescent element.

A first example of a pattern of this second electrode 7 is illustrated in FIG. 7. In this example, the second electrode 7 is divided into two parts by a center line A of the glass substrate 1 extending in the X-axis direction, one part of which is an upper second electrode 71 and the other part of which is a lower second electrode 72. The upper second electrode 71 is formed with an electrode take-out portion R at an upper part 11 of the glass substrate 1 while, on the other hand, the lower second electrode 72 is formed with an electrode take-out portion R at a lower part 12 of the glass substrate 1. By this construction, upper and lower halves of the image screen can be simultaneously scanned, with the result that the cyclic display period of one image screen can be decreased down to ½. As a result, the drive frequency can be made two times higher, whereby the luminance can be increased.

Figure 8:
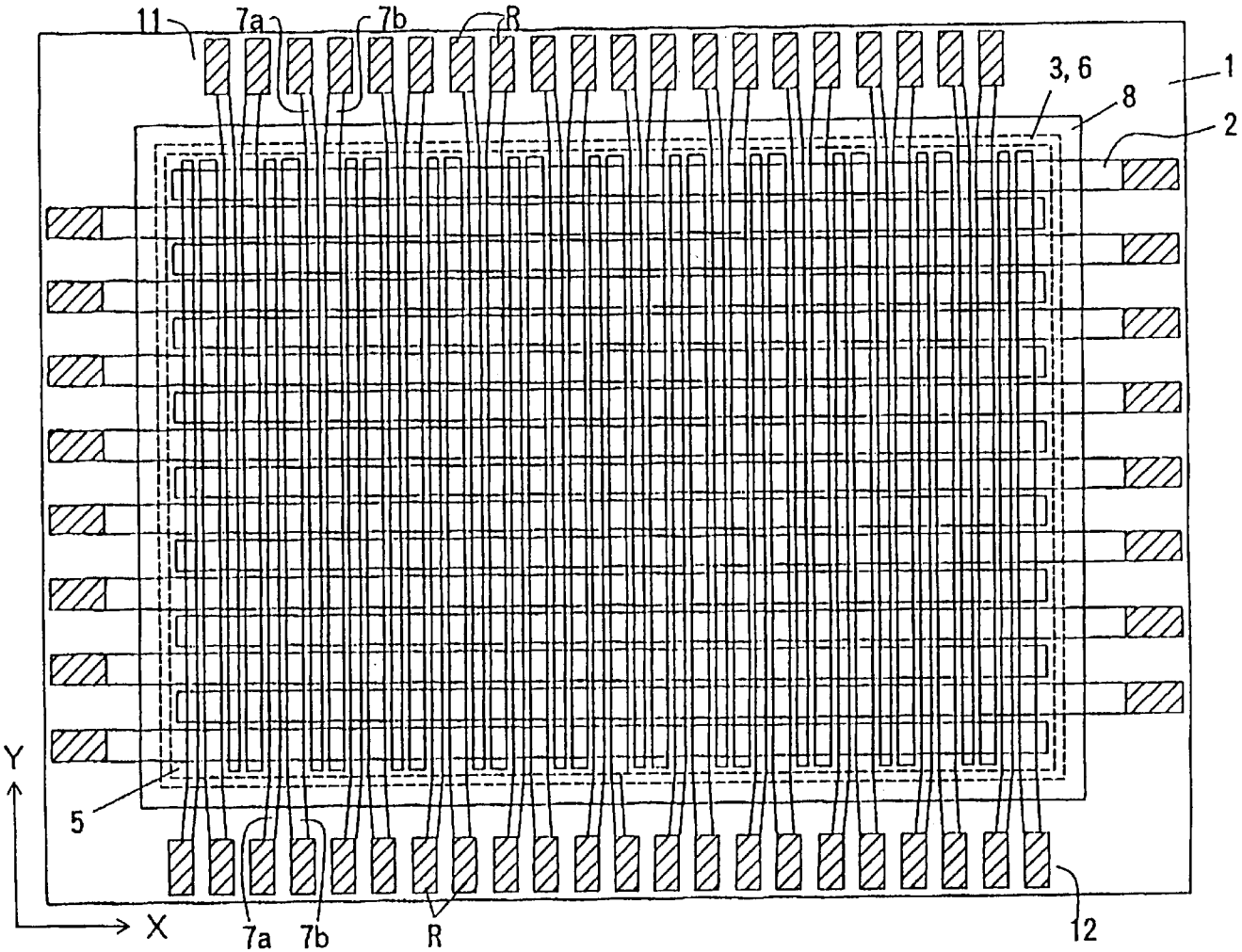
FIG. 8 is a plan view illustrating still another example of the arrangement of the first and second electrodes of the electroluminescent element.

A second example of a pattern of the second electrode 7 is illustrated in FIG. 8. In this example, when, in the same pixel, the red color light emitting second electrode 7*a* existing above the first luminescent layer 4 and the green color light emitting second electrode 7*b* existing above a single layer portion of the second luminescent layer 5 are unified as one set, electrode take-out portions R of each set are formed at an upper part 11 and a lower part 12 of the glass substrate 1 alternately. By this construction, since wiring resistances up to subpixels for red and green colors which form a pixel can be made equal to each other, it is possible to prevent the occurrence of color unevenness when red and green color lights are simultaneously emitted to thereby make a mixed color display. Further, by said construction, the interval between the electrode take-out portions R can be made large, with the result that connection with an external circuit becomes easy.

(Second Embodiment)

Figure 9:
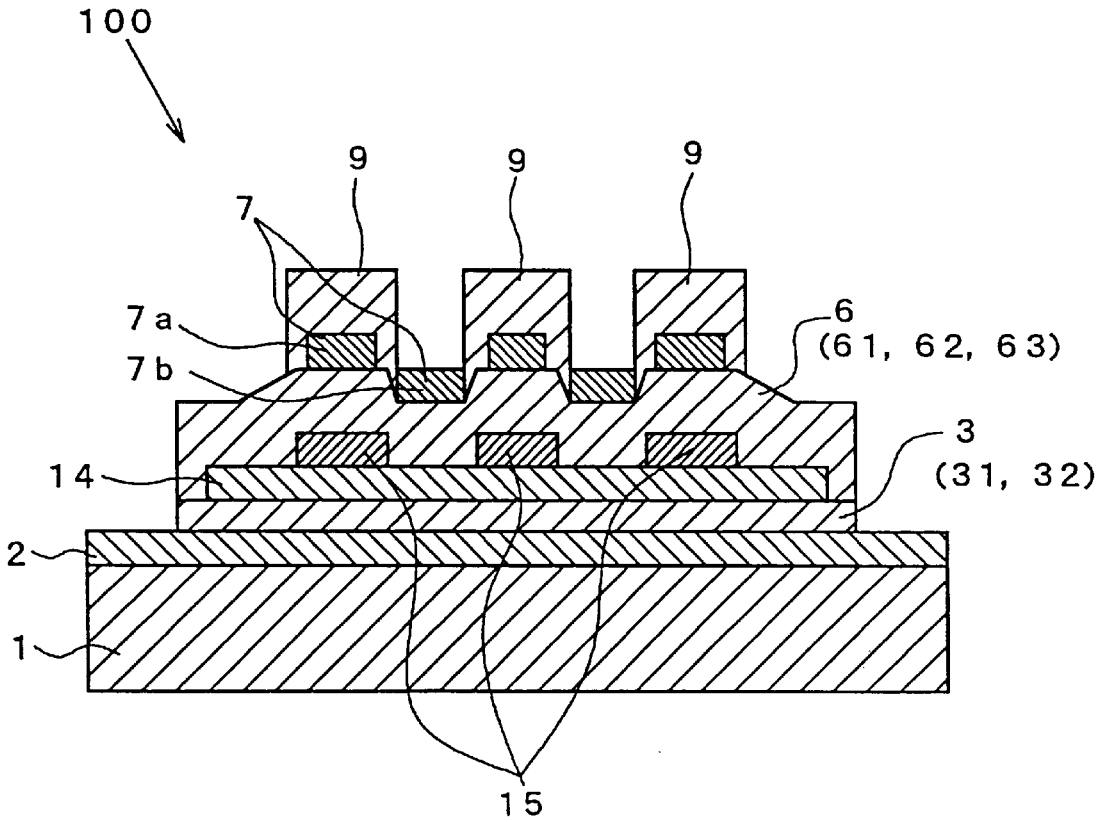
FIG. 9 is a schematic sectional view illustrating the construction of an electroluminescent element of a second embodiment of the present invention.
Figure 10:
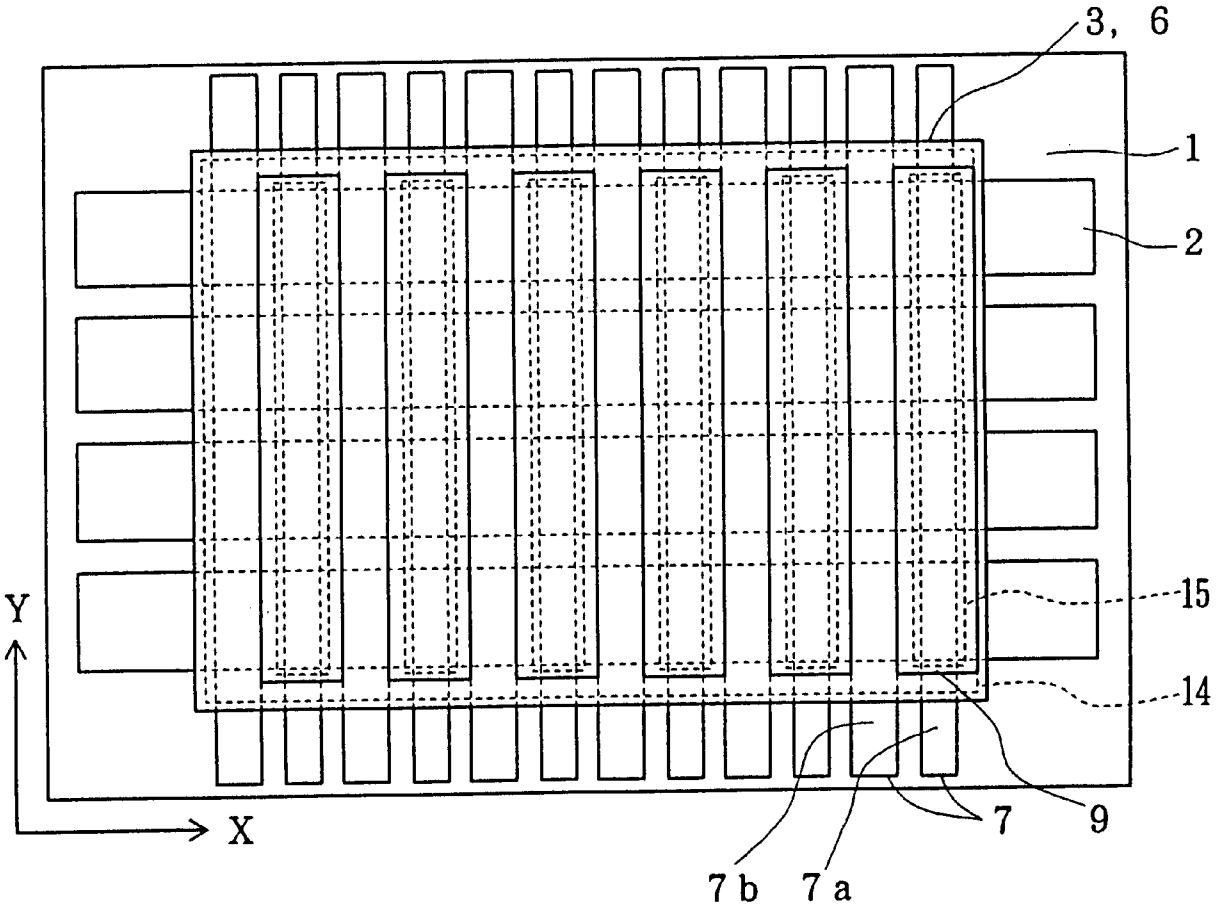
FIG. 10 is a plan view illustrating the arrangement of the first and second electrodes of the electroluminescent element of the second embodiment of the present invention.

FIG. 9 is a typical view illustrating a longitudinal section of an electroluminescent element in a second embodiment, and FIG. 10 is a plan view thereof.

An electroluminescent element 100 in this embodiment differs from that shown in the first embodiment in respect of the construction of the first and second luminescent layers. Namely, in this embodiment, a first luminescent layer 14 consisting of a material of ZnS having TbOF added thereto and having a thickness of 5,000 Å and a second luminescent layer 15 consisting of a material of ZnS having Mn added thereto and having a thickness of 2,000 Å are formed on a first upper insulating layer 32. As illustrated in FIG. 10, the second luminescent layer 15 is patterned such that a plurality of stripes extending in the y-axis direction are arranged in large number at prescribed space intervals in the x-axis direction.

A second insulating layer 6 is uniformly formed on the first luminescent layer 14 and the second luminescent layer 15. Also, in this embodiment, a protective film 8 provided in the first embodiment is not used and a red color filter 9 is formed in a region on a second electrode 7 under which the second luminescent layer 15 exists.

As illustrated in FIG. 10, this red color filter 9 is a plurality stripes formed on the second electrode 7 in such a manner as to cover this electrode 7 and extend in the y-axis direction, and transmits therethrough light emitted from a stacked portion of the first luminescent layer 14 and the second luminescent layer 15.

Figure 11A:
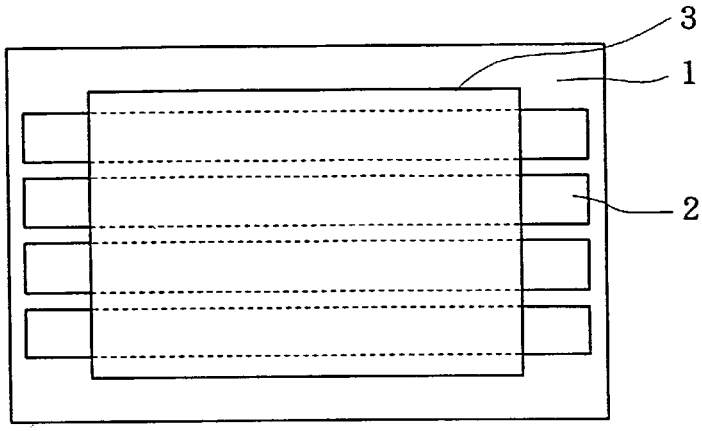
FIGS. 11A to 11C are plan views illustrating a method for manufacturing the electroluminescent element of the second embodiment of the present invention.
Figure 11B:
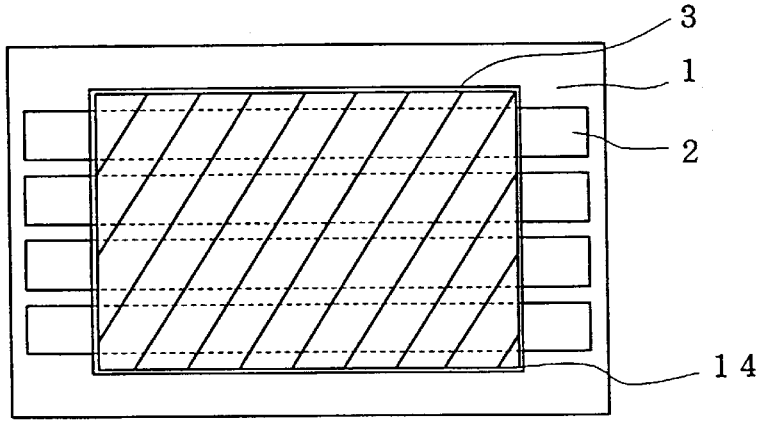
Figure 11C:
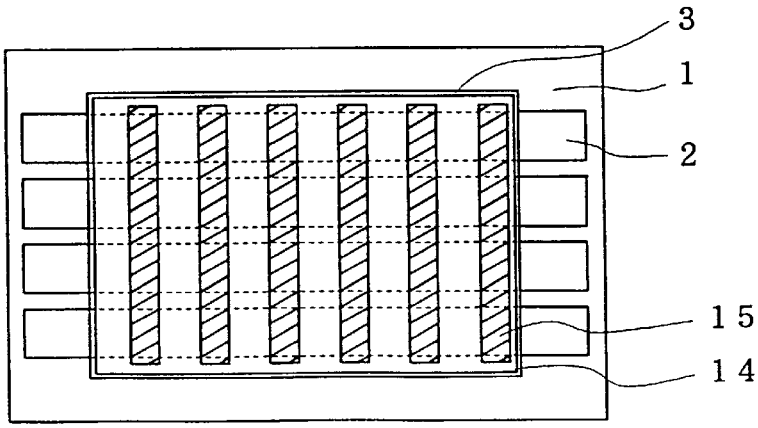

Next, a method for manufacturing the above-mentioned electroluminescent element 100 will be explained below. FIGS. 11A to 11C are plan views illustrating the manufacturing method therefor.

As in the case of the first embodiment, the first electrode 2 and the first insulating layer (first lower insulating layer 31 and first upper insulating layer 32) are formed on the glass substrate 1. This state is illustrated in FIG. 11A.

Then, as illustrated in FIG. 11B, the first luminescent layer 14 consisting of a material of ZnS:TbOF in which ZnS is a host material and TbOF is added thereto as a luminescent center is formed uniformly on the first upper insulating layer 32. Specifically, sputtering is performed with the glass substrate 1 being maintained at a temperature of 250° C. by using Ar and He (helium) as sputter gases at a gaseous pressure of 3.0 Pa with a high frequency power of 2.2 KW to thereby effect film formation.

The glass substrate 1 is thereafter taken out from the sputtering device and then is set within an evaporation device. Therefore, the glass substrate 1 is once exposed in the atmosphere.

Next, a layer consisting of a material of ZnS:Mn in which ZnS is a host material and Mn is added thereto as a luminescent center is formed uniformly by evaporation on the first luminescent layer 14. Specifically, electron beam evaporation is performed with the glass substrate 1 being maintained at a prescribed constant temperature with the interior of the evaporation device being maintained at a pressure level of $5\times10^{-4}$ Pa or less and at a deposition rate of 0.1 to 0.3 nm/sec.

Next, this layer is etched in a configuration as illustrated in FIG. 1C, thereby the second luminescent layer 15 is obtained. Specifically, the glass substrate 1 is maintained at a temperature of 70° C., a gaseous mixture of Ar and $CH_4$ (methane) is introduced into an RIE device, the gaseous pressure is maintained at a level of 7 Pa, and the high frequency power of 1 kW is used to thereby perform dry etching.

In this case, by using a gaseous mixture of $CH_4$ and Ar (inert gas) as an etching gas, the surface of the second luminescent layer 15 having ZnS as the host material is changed to dimethyl zinc $[Zn(CH_3)_2]$ low in boiling point and gasified and physical etching is simultaneously performed with respect thereto by the action of Ar. Accordingly, since the always refreshed surface thereof permits chemical etching which is performed by $CH_4$ to proceed, it is possible to ensure a rate of etching which is conventionally unattainable and etch the second luminescent layer 15 without causing damage to the luminescent layer 14.

After this etching is performed, the luminescent layers 14 and 15 are heat treated in vacuum at 400 to 600° C. Thereafter, as in the first embodiment, the second insulating layers 61 to 63 are formed and the second electrode 7 is formed on the second upper insulating layer 63.

Then, the red color filter 9 is formed on the second electrode 7 in a region under which the second luminescent layer 15 exists to thereby obtain an electroluminescent element having a plan view construction as illustrated in FIG. 10.

In the above-mentioned construction, the first luminescent layer 14 emits green color light and the second luminescent layer 15 emits yellowish orange color light. Light emitted from a stacked portion of the first luminescent layer 14 and the second luminescent layer 15 transmits through the red color filter 9, whereby red color light whose color purity has been increased by the red color filter 9 is obtained.

In this embodiment, when measured from the Q–V characteristic (electric charge vs voltage) of the electroluminescent element, the first luminescent layer 14 consisting of ZnS:TbOF is such that the clamp electric field intensity is in a range of from 1.8 MV/cm to 2.1 MV/cm and the dielectric constant $\epsilon_a$ is in a range of from 8 to 10. Also, the second luminescent layer 15 consisting of ZnS:Mn is such that the clamp electric field intensity is in a range of from 1.4 MV/cm to 1.7 MV/cm and the dielectric constant $\epsilon_a$ is in a range of from 10 to 12. Also, the clamp electric field intensity of the first luminescent layer 14 is higher than that of the second luminescent layer 15 and the product of the dielectric constant and clamp electric field intensity of the second luminescent layer 15 is larger than the product of the dielectric constant and clamp electric field intensity of the first luminescent layer 14. This enables an increase in the luminance of light emitted from the second luminescent layer 15 and a decrease in the luminescence threshold voltage.

At this time, by making the thickness of the second luminescent layer 4 to be 1,000 Å or more, it is possible to obtain a required luminance of the emitted red color light. Also, by making this thickness to be 3,500 Å or less, it is possible to cause the luminescence threshold voltage of the electroluminescent element to fall under a prescribed range. Further, it is possible to operate the electroluminescent element with a drive voltage falling within a limit of the withstand voltage of peripheral parts such as a driver IC, etc.

It is to be noted here that although in the first embodiment the first luminescent layer 4 emitting yellowish orange color light is disposed on the lower side and the second luminescent layer 5 emitting green color light is disposed thereon with the result that there is the likelihood that when the first and second luminescent layers 4 and 5 emit lights, the green color light from the second luminescent layer 5 may leak from a lateral side of the red color filter 9 to deteriorate the color purity. On the other hand when, as mentioned above, the second luminescent layer 15 emitting yellowish orange color light is disposed on the upper side, the leakage of the green color light components can be lessened when the first and second luminescent layers 14 and 15 emit lights, which results in the color purity being increased.

Also, in this embodiment, the red color filter 9 is formed in contact with a widthwise end edge of the electrode 7*b* located above the first luminescent layer 14. As a result of this, it is possible to prevent a decrease in color purity due to leakage of light from between the red color filter 9 and the electrode 7*b*.

Figure 12:
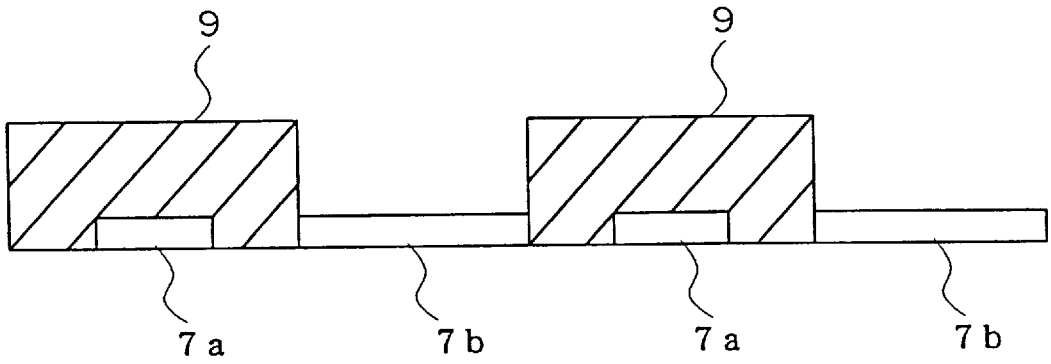
Figure 13:
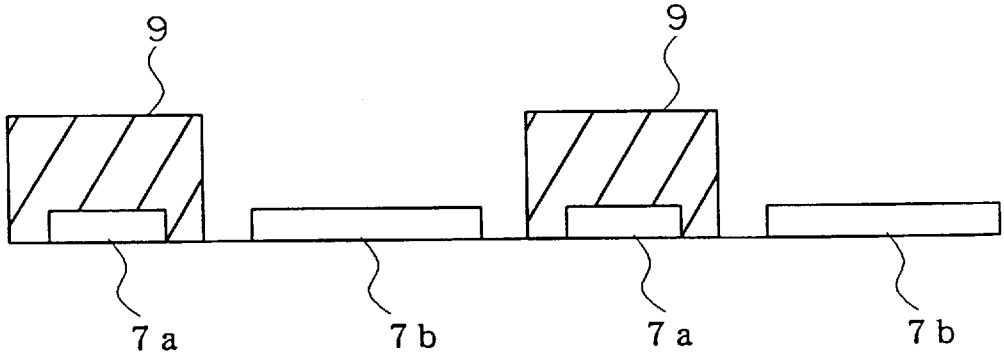

FIGS. 12 and 13 illustrate a relation in width between the red color filter 9 and the second electrodes 7*a*, 7*b*. FIG. 12 illustrate an arrangement wherein the widthwise edge of the red color filter 9 is in contact with the widthwise edge of the second electrode 7*b* and FIG. 13 illustrates an arrangement wherein the widthwise edge of the red color filter 9 is positioned at a center between the second electrodes 7*a* and 7*b*.

Table 1 below illustrates a relation between the color purity (the color purity right above the red color filter) of the pixel and the color purity (the color purity obtained by causing only the red color filter portion to emit light and measuring over a range including both the red color light emitting portion and green color light emitting portion) of the panel when the red color filters having the widths as illustrated in FIGS. 12 and 13 are used. Note that x and y in Table 1 are CIE chromaticity coordinates.

TABLE 1

| | Pixel | | Panel | |
|---|---|---|---|---|
| Structure | x | y | x | y |
| FIG. 12 | 0.62 | 0.37 | 0.61 | 0.38 |
| FIG. 13 | 0.62 | 0.37 | 0.59 | 0.40 |

When the red color filter 9 is disposed as illustrated in FIG. 13, it is seen that the color purity of the panel deteriorates compared to the color purity of the pixel. The reason for this is considered to be that because light emitted from below the red color filter 9 has leaked from a gap between the edge thereof and the second electrode 7*b*, red color light components transmitted through the red color filter 9 and yellow color light components leaked from that gap (mixed color light components of ZnS:Mn and ZnS:Tb) have mixed with the result that the color purity has deteriorated.

Accordingly, by blocking the gap between the second electrodes 7*a* and 7*b* by the red color filter as in this embodiment illustrated in FIG. 12, it is possible to prevent a decrease in color purity due to leakage of light from the above-mentioned gap.

(Modifications of First and Second Embodiments)

Figure 14:
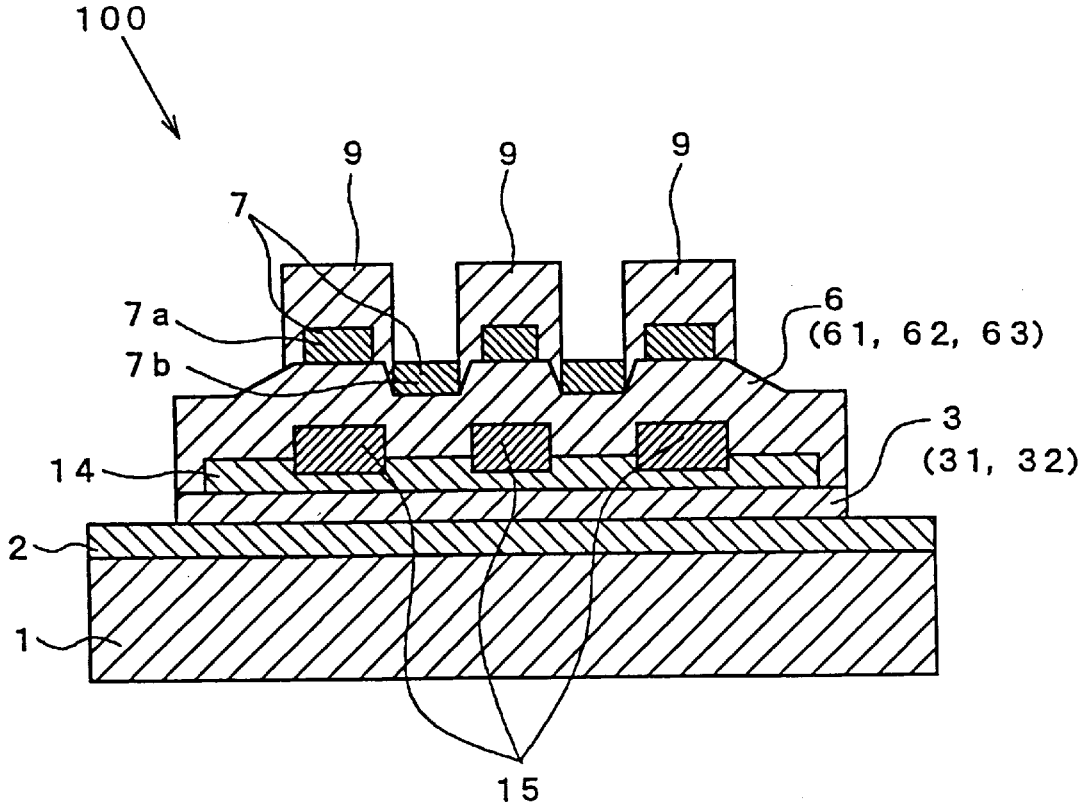
FIG. 14 is a schematic sectional view illustrating the construction of an electroluminescent element in a modified example of the second embodiment.

The above-mentioned second embodiment can also be modified such that, as illustrated in FIG. 14, the first luminescent layer 14 located under the second luminescent layer 15 is etched and decreased in thickness to thereby increase the thickness of the second luminescent layer.

Specifically, after the first luminescent layer 14 is formed 5,000 Å in thickness, a portion of the first luminescent layer 14 at which the second luminescent layer 15 is to be formed is etched 1,000 Å. This etching is performed by dry etching the same as that used when the second luminescent layer 15 was performed. Thereafter, the second luminescent layer 15 is formed 4,000 Å in thickness and this layer is etched to obtain a structure as illustrated in FIG. 14.

As a result, the thickness of a single layer portion of the first luminescent layer 14 is 5,000 Å, the thickness of a stacked portion thereof and the second luminescent layer 15 is 4,000 Å, and the thickness of the second luminescent layer 15 is 4,000 Å.

By decreasing the thickness of the first luminescent layer 14 as mentioned above, it is possible to decrease the luminescence threshold voltage and, by increasing the thickness of the second luminescent layer 15, it is possible to increase the luminance of red color emitted light.

When the first luminescent layer 14 is made 2,000 Å or less in thickness, the dead layer of the second luminescent layer 15 stacked thereon does not decrease. The reason for this is considered to be that when the thickness of the first luminescent layer 14 is 2,000 Å or less, granular growth does not proceed with the result that a state of the surface of the first luminescent layer 14 is bad.

Also, preferably, the difference between the thickness of the first luminescent layer 14 and the thickness of a stacked portion between the first luminescent layer and the second luminescent layer 15 is in a range of from 1,000 Å to 3,500 Å inclusive. By this difference being in such a range, it is possible to make the luminescence threshold voltage of the stacked portion equal to that of the single layer portion and also to increase the luminance of light emitted from the second luminescent layer 15 at the stacked portion between the first luminescent layer 14 and the second luminescent layer 15.

Figure 15:
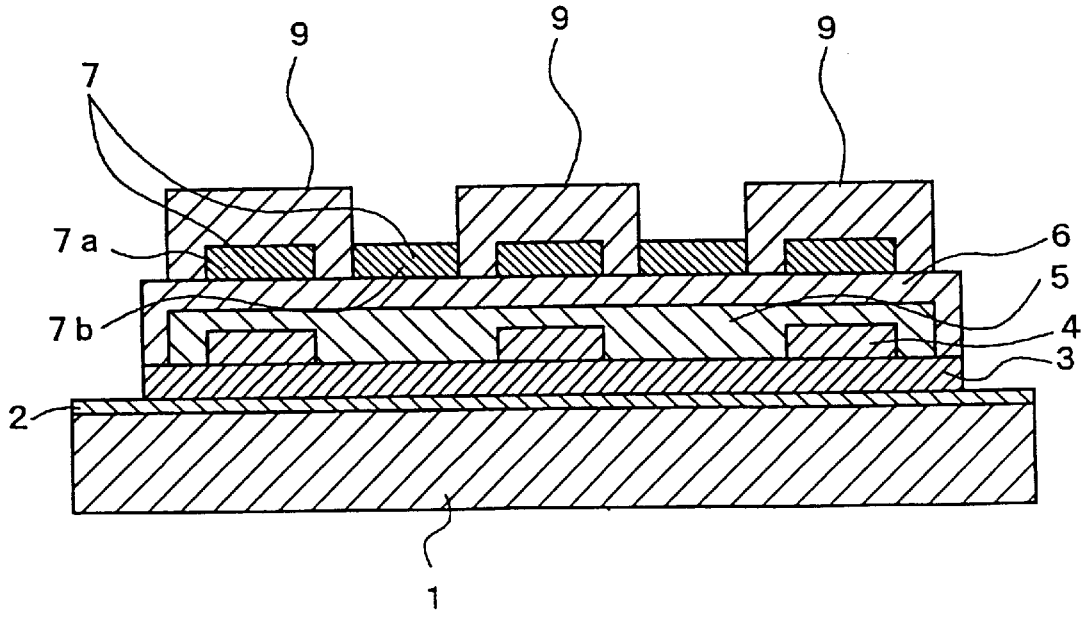
FIG. 15 is a schematic sectional view illustrating the construction of an electroluminescent element in a modified example of the first embodiment.

Also, the above-mentioned first embodiment may be similarly modified such that the thickness of the second luminescent layer 5 at a stacked portion is decreased and the thickness of the first luminescent layer is increased to thereby increase the luminance of red color emitted light. A detailed structure in this case is illustrated in FIG. 15. Note that in this FIG. 15 no protective film 8 is provided.

(Third Embodiment)

Figure 16:
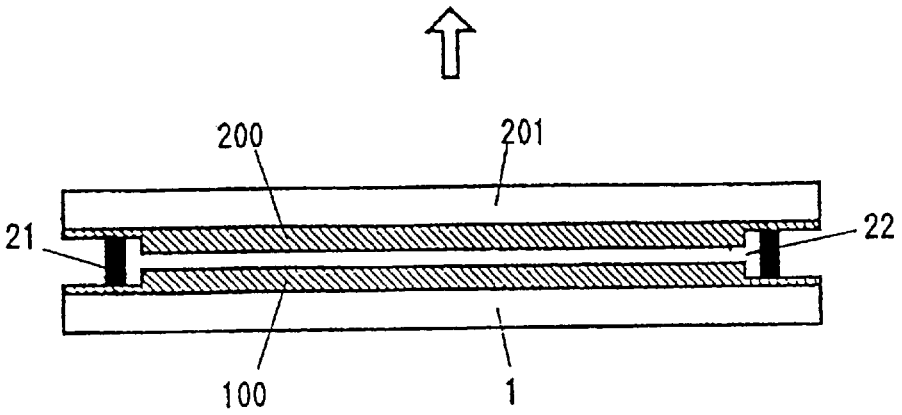
FIG. 16 is a sectional view illustrating a structure wherein an electroluminescent element of a third embodiment of the present invention is assembled.

This third embodiment relates to an electroluminescent element for emission of full color light. As illustrated in FIG. 16, the electroluminescent element 100 shown in the first and second embodiments and a blue color light emitting electroluminescent element 200 are bonded together at a peripheral portion by means of a frame member 21 and silicon oil 22 is filled in an internal space of the resulting structure.

Figure 17:
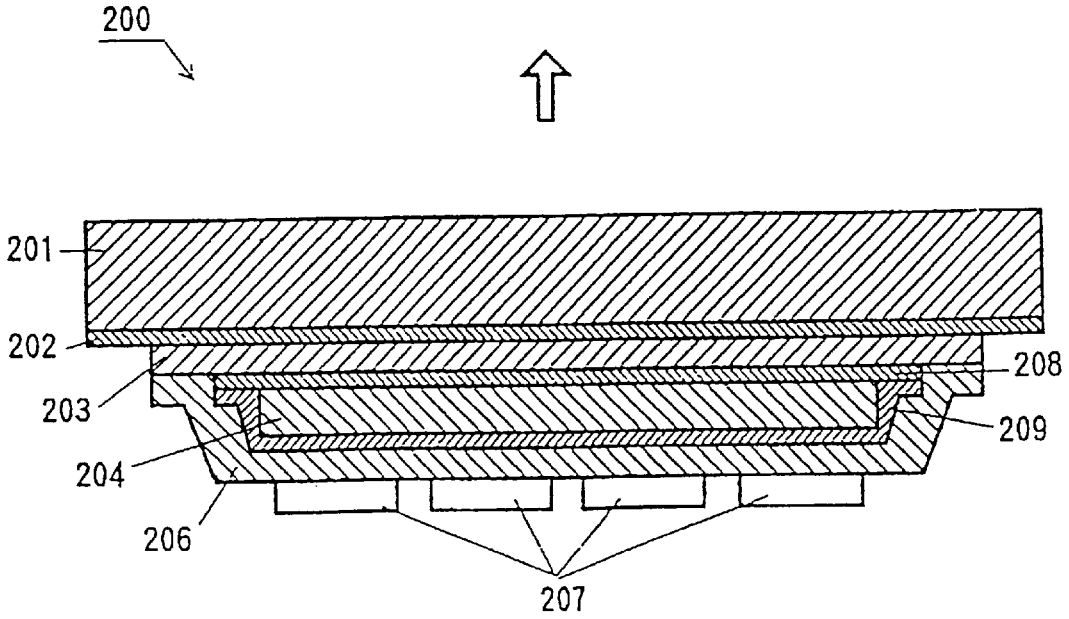
FIG. 17 is a sectional view illustrating the construction of a blue color light emitting electroluminescent element part in the third embodiment.

The blue color light emitting electroluminescent element 200 has a structure as illustrated in FIG. 17. Namely, on a transparent glass substrate 201 there is formed a first electrode 202 consisting of an optically transparent ITO (Indium Tin Oxide) and having a thickness of 2,000 Å. As in the case of the first electrode 2 in the first embodiment, the first electrode 202 is disposed such that a plurality of stripes extending in the x-axis direction are arranged in large number in the y-axis direction.

A first insulating layer 203 is formed uniformly on the glass substrate 201 having the first electrode 202 formed thereon. This first insulating layer 203 is composed of two layers as in the first embodiment, one of which is a first lower insulating layer consisting of an optically transparent material of $SiO_xN_y$ and having a thickness of 500 to 1,000 Å and the other of which is a first upper insulating layer consisting of a composite film of $Ta_2O_5$:$Al_2O_3$ and having a thickness of 2,000 to 3,000 Å.

Then, on the first insulating layer 203 there are sequentially formed a protective film 208 consisting of ZnS and 2,000 Å in thickness and a luminescent layer 204 having a thickness of 10,000 Å (=1 $\mu$m). This luminescent layer 204 is formed of a material of SrS having Ce added thereto.

On the luminescent layer 204 there is formed a protective film 209 made of the same material as that of the protective film 208 and, on this protective film 209, a second insulating layer 206 is formed uniformly. As in the case of the first embodiment, the second insulating layer is composed of three layers, a first one of which is a second lower insulating layer consisting of an optically transparent material of $Si_3N_4$ and having a thickness of 1,000 Å, a second one of which is a second intermediate insulating layer consisting of a composite film of $Ta_2O_5$ and $Al_2O_3$, and a third one of which is a second upper insulating layer consisting of $SiO_xN_y$and having a thickness of 1,000 Å.

On the second insulating layer 206 there is formed a second electrode 207 consisting of an optically transparent material of $ZnO:Ga_2O_3$ and having a thickness of 4,500 Å. The second electrode 207 is disposed such that a plurality of stripes extending in the y-axis direction are arranged in large number in the x-axis direction as in the case of the first embodiment.

The above-mentioned blue color light emitting electroluminescent element 200 is basically manufactured in the same manner as in the first embodiment except for a blue color luminescent layer. Therefore, a specific method for manufacturing only a blue color luminescent layer will be explained.

The glass substrate 201 having been formed with the protective film 208 consisting of non-doped ZnS was maintained at a constant temperature of 500° C., whereby sputtering was performed using a sintered material of SrS:Ce as a target in a gaseous atmosphere of Ar, $H_2S$ (hydrogen sulfide) and He under a gaseous pressure of 4.0 Pa with a high frequency power of 2.4 KW (power density: 2.47 $W/cm^2$) to thereby make film formation. Heat treatment was then performed in vacuum at 500 to 600° C. and subsequently the protective film 209 the same as the protective film 208 was formed on the resulting film to thereby form a blue color luminescent layer.

Usually, the color of light emitted from the electroluminescent element using SrS:Ce is bluish green. However, the electroluminescent element obtained in this embodiment exhibits an increased spectrum of emitted light having a wavelength of 500 nm or less and therefore is whitish blue.

Figure 18:
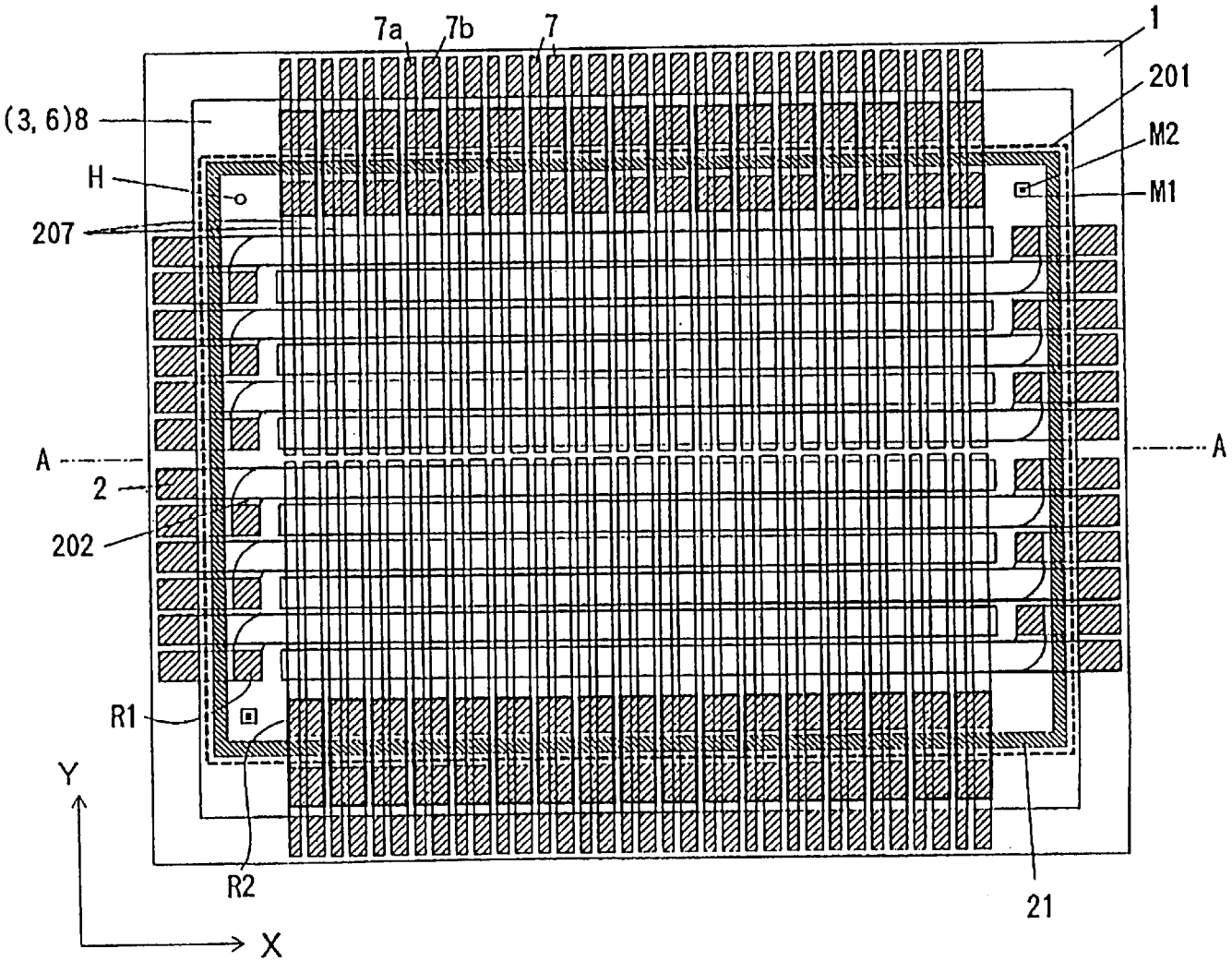
FIG. 18 is a plan view illustrating the construction of the electroluminescent element of the third embodiment.
Figure 19:
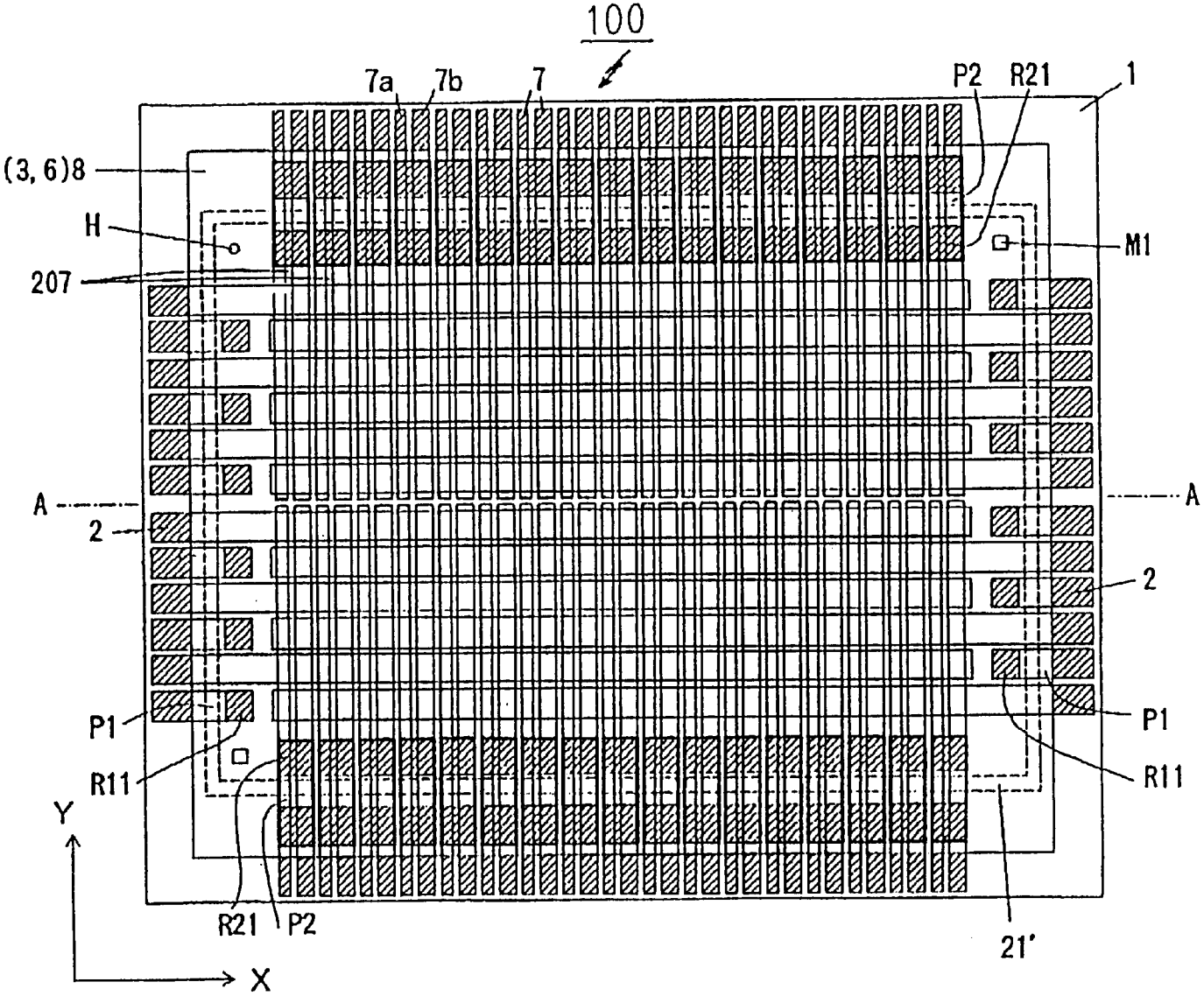
FIG. 19 is a plan view illustrating the construction of a red/green color light emitting electroluminescent element part constituting the electroluminescent element of the third embodiment.
Figure 20:
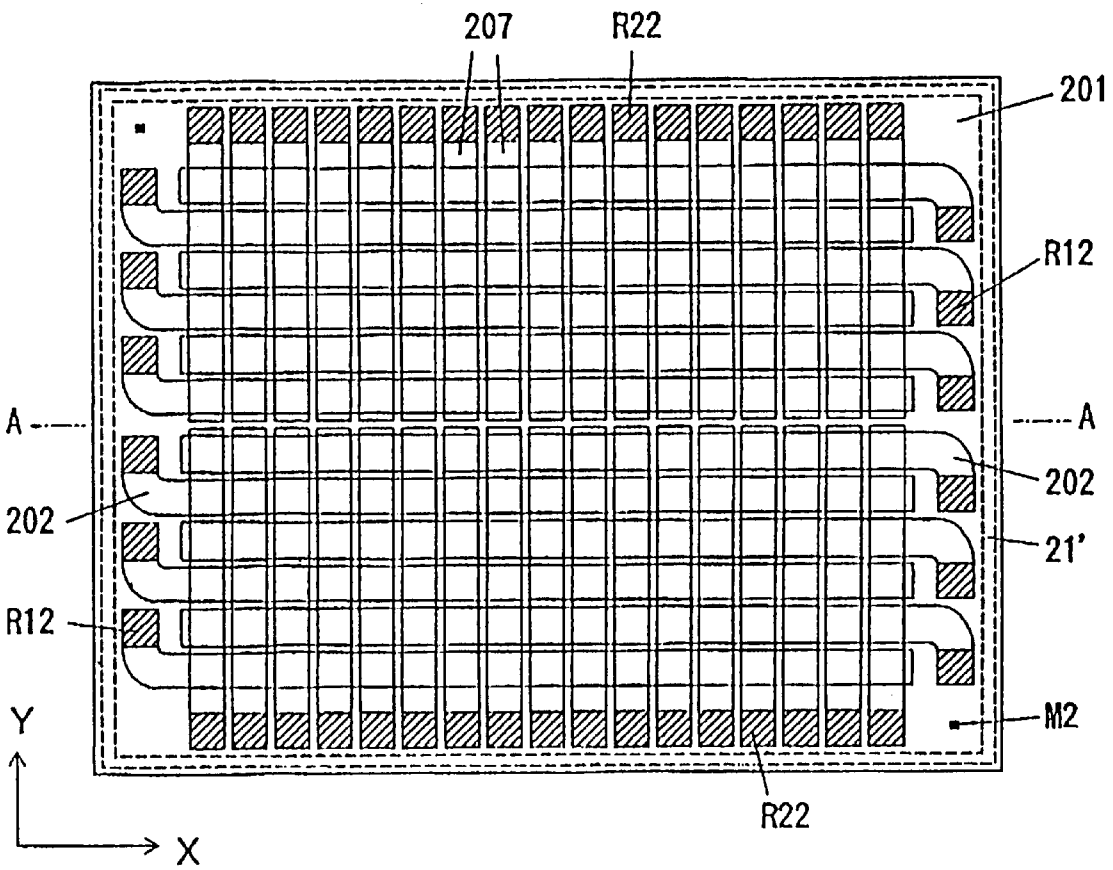
FIG. 20 is a plan view illustrating the construction of a blue color light emitting electroluminescent element part constituting the electroluminescent element of the third embodiment.

The blue color light emitting electroluminescent element 200 manufactured as mentioned above is bonded to the electroluminescent element 100 as illustrated in FIG. 16. FIG. 18 is a typical view of a state of this superposition which has been taken as a plan view, FIG. 19 is a typical plan view of the electroluminescent element 100 prior to the superposition, and FIG. 20 is a typical plan view of the blue color electroluminescent element 200 prior to the superposition.

The relationship between the superposed elements will now be described hereafter with reference to FIGS. 18 to 20.

Note that these figures show principally the electrode wiring patterns and the electrode take-out portions and do not show the luminescent layers, filters, etc. While the electroluminescent element 100 illustrated in FIG. 19 is basically formed as in the first embodiment, for bond to the blue color electroluminescent element 200 connection pads P1 and P2 and connection terminal portions R11 and R21 of this element 100 to the electrodes 202 and 207 of the blue color electroluminescent element 200 are each formed of a conductive metallic film such as that made of Ni, Au or the like.

In this embodiment, the horizontal scan electrodes 2 are formed such that they project alternately to the right and left every second scan electrode, and the connection pads P1 are formed at the end portions of the substrate between the scan electrodes. Also, the connection pads P2 are formed on the vertical signal electrodes 7.

The connection terminal portions R11 and R21 each consisting of solder (Pb—Sn alloy) film or the like are formed at prescribed positions on the connection pads P1 and P2.

Meanwhile, as in the case of the electroluminescent element 100, connection terminal portions R12 and R22 each consisting of solder film or the like are formed at the end portions of the electrodes of the blue electroluminescent element 200 illustrated in FIG. 20. The positions of these connection terminal portions R12 and R22 are arranged such that when the both electroluminescent elements are superposed each other in a face to face relation, the R11 and R21 overlap upon the R12 and R22 in corresponding relation to each other.

A scan electrode 202 is equal in width to the scan electrode 2 of the electroluminescent element 100, is parallel therewith, and is arranged overlapping thereupon in a direction in which light is taken out. In addition, the connection terminal portions R12 of the scan electrodes 202 are each bent so that the scan electrode may be connected to an external circuit or the like at the same side of the substrate. The superposition between the elements 100 and 200 can be made accurately positioned by alignment marks M1 and M2 formed therein.

The electroluminescent element 100 and the electroluminescent element 200 are bonded together by means of the frame member 21 and, by heating the overlapping connection terminal portions R1 and R2 from outside the substrate by a laser beam heating device or the like, the solder films or the like are fused together to thereby connect the electrodes of the blue color electroluminescent element 200 to the connection pad portions formed on the substrate 1 of the electroluminescent element 100. Then, the silicon oil 22 is filled in the resulting structure from an injection opening (hole) formed in the substrate 1 beforehand and the injection opening is sealed.

By superposing the both elements as mentioned above, it is possible to make the wiring length up to red subpixel, green subpixel and blue subpixel constituting one pixel substantially equal and make same the tendencies of the luminances resulting from the wiring resistance, with the result that it is possible to realize multicolor display with no unevenness in color following when mixing of color occurs.

Figure 21:
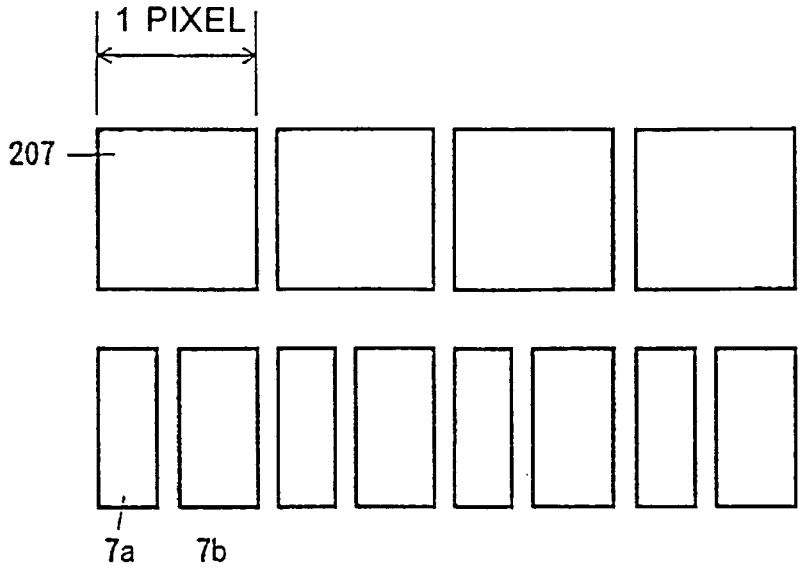
FIG. 21 is a view illustrating a relationship between the widths of second electrodes of the electroluminescent element of the third embodiment.

Also, as illustrated in FIG. 21, the second electrode 207 of the blue color electroluminescent element 200 and the second electrode 7 of the electroluminescent element 100 are parallel with each other, the width of the second electrode 207 corresponds to the width of one pixel, and within this range of width the red color light emitting second electrode **7*a* and green color light emitting second electrode 7*b* are arranged. In this state, the area ratio between the second electrodes 7*a* and 7*b* is adjusted so that the luminance ratio among red, green and blue color lights as emitted may be 3:6:1, whereby the thickness of the blue color light emitting electroluminescent element 200** is adjusted.

By making the luminance ratio among red, green and blue color lights as emitted to be 3:6:1 (the ratio of red to green is 1:2), it is possible to obtain a display color near to the color of natural light.

The host material of the luminescent layer 204 of the blue color light emitting electroluminescent element 200 may be $MGa_2S_4$ (M=Ca, Ba, Sr). Further, $CeF_3$ as well as Ce can be used as an additive. Since a method for manufacturing each of these luminescent layers is substantially the same, a specific method for manufacturing a blue color light emitting layer of $CaGa_2S_4$:Ce will hereafter be explained representatively. Also, since the films other than the luminescent layer are formed in the same manner as in the case of the first embodiment, a manufacturing method for the luminescent layer will be shown below.

With the glass substrate 201 being maintained at a constant temperature of 200° C., sputtering is performed using a sintered material of $CaGa_2S_4$:Ce as a target in a gaseous atmosphere of Ar, and $H_2S$ under a gaseous pressure of 1.0 Pa under a condition of 2.4 KW (power density: 2.47 $W/cm^2$) high frequency power to thereby form a film having a thickness of 6,000 Å. Thereafter, the resulting film is heat treated in a gaseous atmosphere of $H_2S$ at a temperature of 600° C. or more (approximately 630° C.) to thereby form a blue color luminescent layer. The spectrum of light emitted from this blue color electroluminescent element has a main peak at around 460 nm and exhibits a very high color purity of blue color (x=0.15, y=0.19 in terms of CIE chromaticity coordinates).

Also, the blue color luminescent layer may be constituted by stacking the luminescent layer of $CaGa_2S_4$:Ce and a ZnS luminescent layer having Tm added thereto. In this case, since the ZnS luminescent layer having Tm added thereto exhibits very pure blue color emitted light, it is possible to increase the blue color purity of the blue color emitting luminescent layer.

Note that since Tm is larger in ion diameter than Zn, the resulting ZnS luminescent layer becomes higher in clamp electric field intensity than non-doped ZnS. Accordingly, it is possible to increase the luminance of light emitted from the $CaGa_2S_4$:Ce luminescent layer by making the clamp electric field intensity of the Tm added ZnS luminescent layer higher than that of the $CaGa_2S_4$:Ce luminescent layer. Note also that Tm can be added to ZnS in an adding form of $TmF_3$, $TmCl_3$ or the like.

(Other Embodiments)

Figure 22:
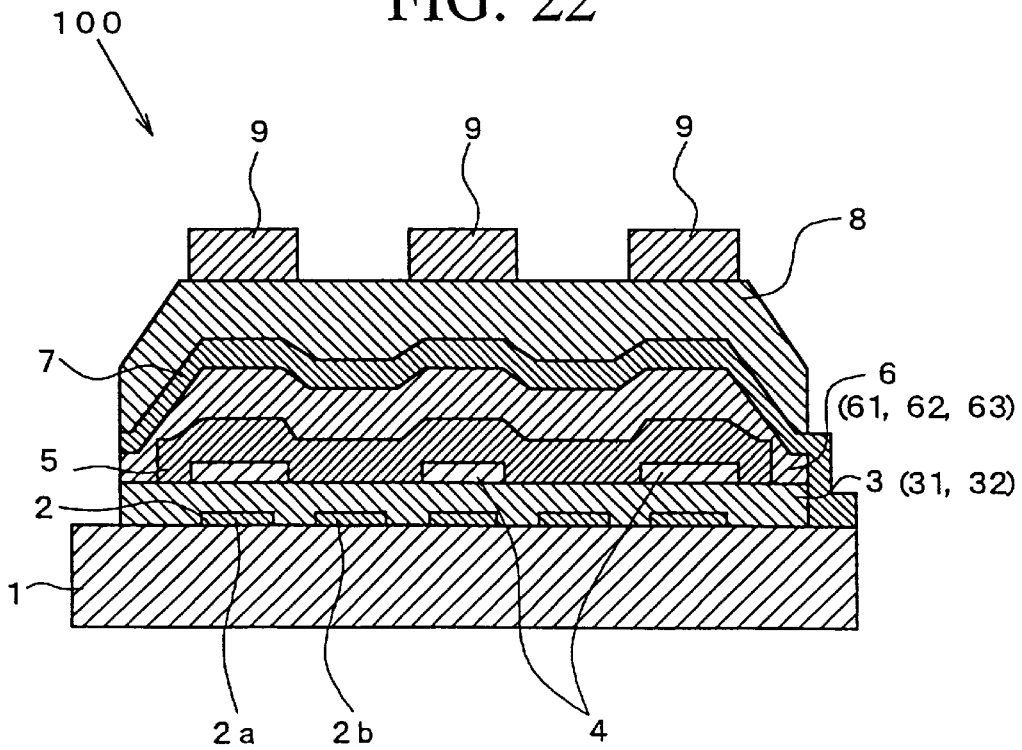
FIG. 22 is a schematic sectional view illustrating a modified example wherein the first electrodes 2 are used as column electrodes and the second electrodes 7 are used as row electrodes unlike the construction illustrated in FIG. 1.
Figure 23:
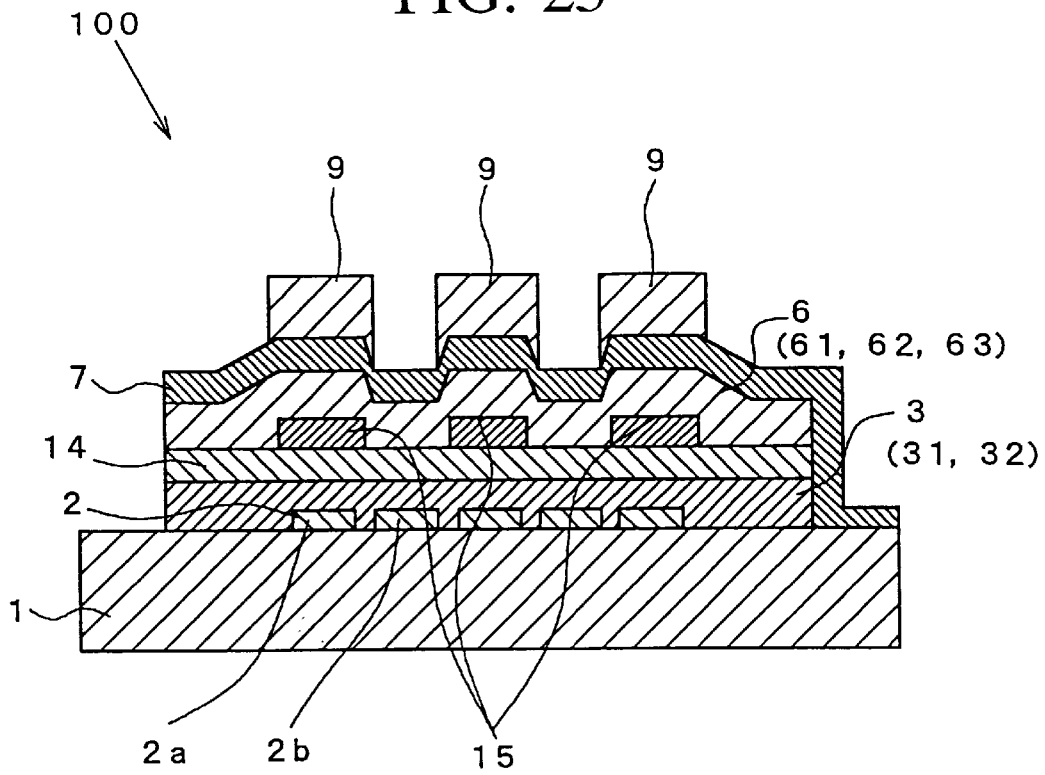
FIG. 23 is a schematic sectional view illustrating a modified example wherein the first electrodes 2 are used as column electrodes and the second electrodes 7 are used as row electrodes unlike the construction illustrated in FIG. 9.

Although in the above-mentioned first and second embodiments explanation was given of the case where the first electrodes are row electrodes and the second electrodes 7 are column electrodes, it may also be arranged such that the first electrodes are column electrodes and the second electrodes are row electrodes. Specifically, as illustrated in FIGS. 22 and 23 (corresponding to FIGS. 1 and 9), the first electrodes 2 (2*a*, 2*b*) are disposed as column electrodes and the second electrodes 7 are disposed as row electrodes.

Also, in any one of the above-mentioned embodiments, the red color filter 9 can be constituted by a resist filter wherein red dye or pigment has been dispersed in an organic solvent.

Also, the protective film 8 can be constituted by organic material such as heat-resisting resin or the like. When the thickness of the protective film 8 is large, positional displacement occurs which results in that the angle of vision field becomes narrowed. Therefore, the thickness of the protective film 8 is preferably 5 $\mu$m or less. On the other hand, when the thickness thereof is too small, the coverage of the pattern edge portions of the upper electrodes deteriorates with the result that the electroluminescent element becomes likely to break down due to entry of water components. Therefore, the thickness of the protective film 8 is preferably 8,000 Å (0.8 $\mu$m) or more.

As an additive contained in the host material of ZnS of the first luminescent layer 4, $MnF_2$ and $MnCl_2$ as well as Mn can be used. Also, as an additive contained in the host material of ZnS of the second luminescent layer 5, TbOF, $TbF_3$ and $TbCl_3$ as well as Tb can be used.

Figure 24:
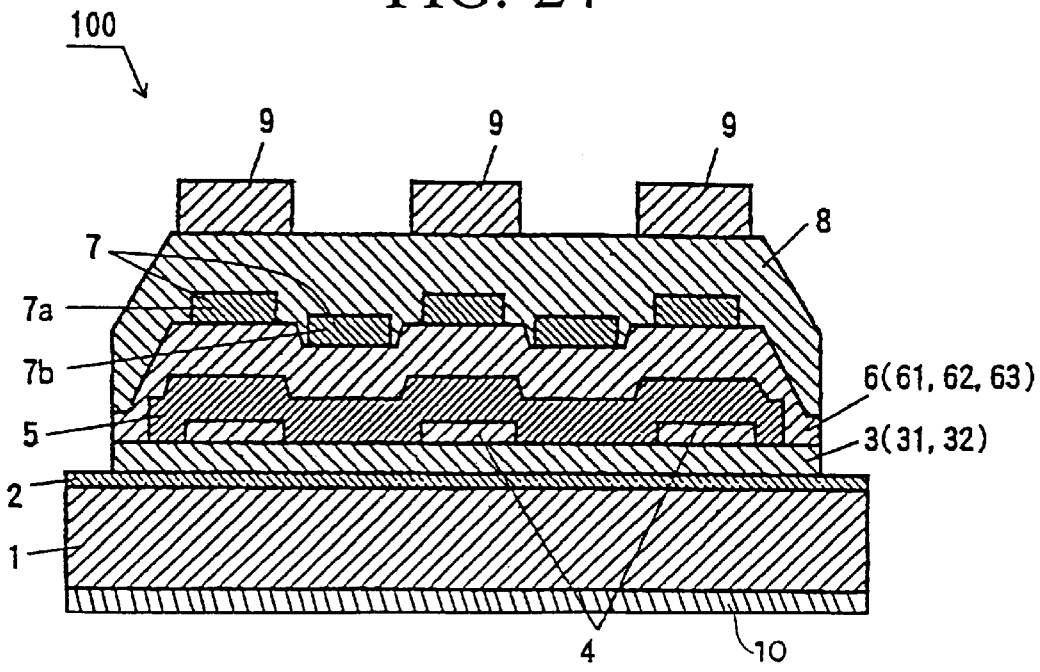
FIG. 24 is a schematic sectional view illustrating the construction of an electroluminescent element of the other embodiment of the present invention.

Also, as illustrated in FIG. 24, it may be arranged such that the first electrode 2 is formed of a transparent electrode and resin containing black pigment (black color background film), i.e., a black layer 10 is formed on a side opposite to the side of the glass substrate 1 on which the electrodes are formed. In this case, it becomes difficult to visually recognize the red color filter 9 to thereby enable a decrease in the unnaturalness in color due to the red color filter 9.

Furthermore, the electroluminescent element of the invention is not limited to one having insulating layers on both sides of its luminescent layer or layers but may be one having an insulating layer on only one side thereof.

While the present invention has been shown and described with reference to the foregoing preferred embodiments, it will be apparent to those skilled in the art that changes in form and detail may be made therein without departing from the scope of the invention as defined in the appended claims.

What is claimed is:

1. An electroluminescent element comprising:

a pair of electrodes, at least one of which is transparent, disposed on a substrate;

a luminescent layer having upper and lower surfaces;

a compound semiconductor layer stacked on at least one of said upper and lower surfaces of said luminescent layer to form a stacked luminescent/compound semiconductor layer; and insulating layers, at least a first of said insulating layers interposed between a first of said pair of electrodes and said stacked luminescent/compound semiconductor layer and at least a second of said insulating layers interposed between a second of said pair of electrodes and said stacked luminescent/compound semiconductor layer, wherein said compound semiconductor layer is selected to have a clamp electric field intensity higher than that of said luminescent layer.

2. An electroluminescent element according to claim 1, wherein said luminescent layer and said compound semiconductor layer are made of the same host material.

3. An electroluminescent element according to claim 1, wherein said compound semiconductor layer is disposed between said luminescent layer and whichever one of said insulating layers is in closer proximity to said substrate.

4. An electroluminescent element according to claim 1, wherein said compound semiconductor layer contains at least one selected from the group consisting of a Group II–VIb compound semiconductor and a Group II–IIIb–VIb compound semiconductor.

5. An electroluminescent element according to claim 4, wherein said compound semiconductor layer contains a clamp electric field intensity additive which makes the clamp electric field intensity of said compound semiconductor layer higher than that of said luminescent layer.

6. An electroluminescent element according to claim 5, wherein said clamp electric field intensity additive is at least one element selected from Cd, Mn, Tb, Sm, Tm, and Ce.

7. An electroluminescent element according to claim 4, wherein:

said luminescent layer comprises as a host material at least one member selected from the group consisting of a Group II–VIb compound semiconductor and a Group II–IIIb–VIb compound semiconductor and as a luminescent center a first element; and said compound semiconductor layer comprises as a clamp electric field intensity adjusting additive a second element, said second element having an ion radius larger than that of said first element.

8. An electroluminescent element according to claim 7, wherein said clamp electric field intensity additive is selected from the group consisting of Tb, Sm, Tm, and Ce.

9. An electroluminescent element according to claim 1, wherein said compound semiconductor layer is one in which no electroluminescence in a range of visible light occurs.

10. An electroluminescent element according to claim 1, wherein said compound semiconductor layer produces the same electroluminescence as said luminescent layer.

11. An electroluminescent element comprising:

a pair of electrodes, at least one of which is transparent, disposed on a substrate;

a luminescent layer having upper and lower surfaces;

a compound semiconductor layer stacked on at least one of said upper and lower surfaces of said luminescent layer to form a stacked luminescent/compound semiconductor layer; and insulating layers, at least a first of said insulating layers interposed between a first of said pair of electrodes and said stacked luminescent/compound semiconductor layer and at least a second of said insulating layers interposed between a second of said pair of electrodes and said stacked luminescent/compound semiconductor layer, wherein said compound semiconductor layer is selected to have a clamp electric field intensity higher than a clamp electric field intensity of said luminescent layer, and wherein the product of a dielectric constant and said clamp electric field intensity of said luminescent layer is larger than the product of a dielectric constant and said clamp electric field intensity of said compound semiconductor layer.

12. An electroluminescent element comprising:

a pair of electrodes, at least one of which is transparent, disposed on a substrate;

a first luminescent layer having upper and lower surfaces;

a second luminescent layer stacked on either one of said upper and lower surfaces of said first luminescent layer to form stacked luminescent layers; and insulating layers, at least a first of said insulating layers interposed between a first of said pair of electrodes and said stacked luminescent layers and at least a second of said insulating layers interposed between a second of said pair of electrodes and said stacked luminescent layers, wherein said second luminescent layer and said first luminescent layer have different clamp electric field intensities, and wherein the product of a dielectric constant and said clamp electric field intensity of said luminescent layer having a lower clamp electric field intensity is larger than the product of a dielectric constant and said clamp electric field intensity of said luminescent layer having a higher clamp electric field intensity.

13. An electroluminescent element according to claim 12, wherein:

said first luminescent layer comprises a first host material containing at least one member selected from the group consisting of a Group II–VIb compound semiconductor and a Group II–IIIb–VIb compound semiconductor, and a first element incorporated in said first host material as a luminescent center of said first luminescent layer, said first element controlling said clamp electric field intensity of said first luminescent layer;

said second luminescent layer comprises a second host material containing at least one member selected from the group consisting of a Group II–VIb compound semiconductor and a Group II–IIIb–VIb compound semiconductor, and a second element incorporated in said second host material as a luminescent center of said second luminescent layer, said second element controlling said clamp electric field intensity of said second luminescent layer; and said second element has an ion radius larger than that of said first element.

14. An electroluminescent element according to claim 13, wherein said first and second elements are selected from the group consisting of Tb, Sm, Tm, and Ce.

15. An electroluminescent element according to claim 12, wherein said first luminescent layer is made of ZnS containing Mn and said second luminescent layer is made of ZnS containing Tb, said first luminescent layer being such that said clamp electric field intensity thereof is in a range of from 1.4 MV/cm to 1.7 MV/cm and said dielectric constant thereof is in a range of from 10 to 12 while said second luminescent layer is such that said clamp electric field intensity thereof is in a range of from 1.8 MV/cm to 2.1 MV/cm and said dielectric constant thereof is in a range of from 8 to 10.

16. An electroluminescent element according to claim 12, wherein said first luminescent layer is made of ZnS containing Tb and said second luminescent layer is made of ZnS containing Mn, said first luminescent layer being such that said clamp electric field intensity thereof is in a range of from 1.8 MV/cm to 2.1 MV/cm and said dielectric constant thereof is in a range of from 8 to 10 while said second luminescent layer is such that said clamp electric field intensity thereof is in a range of from 1.4 MV/cm to 1.7 MV/cm and said dielectric constant thereof is in a range of from 10 to 12.

17. An electroluminescent element comprising:

a first electrode formed on a substrate;

a first insulating layer formed on said first electrode;

a first luminescent layer formed on said first insulating layer, said first luminescent layer comprising a plurality of pieces arranged such that portions of said first insulating layer are exposed between adjacent ones of said pieces;

a second luminescent layer comprising stacked layer portions formed on corresponding ones of said pieces of said first luminescent layer and single layer portions formed on corresponding ones of said portions of said first insulating layer exposed between adjacent ones of said pieces;

a second insulating layer formed on said second luminescent layer; and a second electrode formed on said second insulating layer, wherein said first and second luminescent layers have clamp electric field intensities different from each other so that the product of a dielectric constant and said clamp electric field intensity of said luminescent layer having a lower clamp electric field intensity is larger than the product of a dielectric constant and said clamp electric field intensity of said luminescent layer having a higher clamp electric field intensity.

18. An electroluminescent element according to claim 17, wherein said first luminescent layer is made of ZnS containing Mn and said second luminescent layer is made of ZnS containing Tb.

19. An electroluminescent element according to claim 18, wherein:

said stacked layer portions of said second luminescent layer are equal in thickness to said single layer portions of said second luminescent layer; and a ratio of the thickness of said first luminescent layer to the thickness of said second luminescent layer existing on said first luminescent layer is in a range of from 1:1.5 to 1:5.0 inclusive.

20. An electroluminescent element according to claim 19, wherein the thickness of said first luminescent layer is in a range of from 1,000 Å to 3,500 Å inclusive.

21. An electroluminescent element according to claim 18, wherein said stacked layer portions of said second luminescent layer have smaller thicknesses than said single layer portions of said second luminescent layer.

22. An electroluminescent element according to claim 18, wherein said second electrode is composed of a transparent conductive film and a red color filter is disposed over said second electrode so as to correspond to a region where said first luminescent layer is disposed thereunder.

23. An electroluminescent element according to claim 22, wherein:

said first electrode comprises a plurality of first electrode lines and said second electrode comprises a plurality of second electrode lines;

said first electrode lines or said second electrode lines define column electrodes and the other of said first or second electrode lines define row electrodes, said column and row electrodes intersecting at right angles to collectively form a dot matrix;

said column electrodes comprise first column electrodes provided for said stacked layer portions and second column electrodes provided for said single layer portions, said first column electrodes and second column electrodes being disposed alternately;

said red color filter has a plurality of pieces, each formed into a stripe shape;

said pieces of said first luminescent layer on which said stacked layer portions of said second luminescent layer are formed have stripe shapes; and each of said pieces of said first luminescent layer is aligned with a corresponding one of said pieces of said red color filter and a corresponding one of said first column electrodes to form a set.

24. An electroluminescent element according to claim 23, wherein each set has an adjacent one of said second column electrodes, and wherein for each set, said piece of said first luminescent layer has a stripe width W, said column electrode has a line width $W_1$, and said first and second column electrodes are separated by intervals $W_2$, and further wherein a relationship of $W_1 \leqq W < W_1 + 2 \times W_2$ holds true.

25. An electroluminescent element according to claim 23 wherein:

said column electrodes are said second electrode lines; and said first column electrodes where said first luminescent layer is disposed thereunder and said second column electrodes where said first luminescent layer is not disposed thereunder have respective line widths selected so that the ratio between the luminance of light transmitted through said red color filter and the luminance of said second luminescent layer at said single layer portions is 1:2.

26. An electroluminescent display apparatus comprising as a rear side element that emits red and green color lights said electroluminescent element according to claim 23 and as a front side element another electroluminescent element that emits a blue color light, wherein:

said front side element is a dot-matrix transparent element comprising column and row electrodes arranged to intersect each other at a right angle;

respective row electrodes of said front side element and said rear side element have the same width and are disposed in parallel with each other to overlap each other; and said column electrodes of said front side element have a width equal to the width of a pixel of said rear side element and are disposed in parallel with said column electrodes of said rear side element to overlap with said first column electrodes and said second column electrodes of said rear side element, respectively, said pixel of said rear side element being composed of a subpixel for red color emission and a subpixel for green color emission.

27. An electroluminescent element according to claim 22, wherein said red color filter is a long pass filter which permits transmission therethrough of light having a wavelength of 590 nm or more and interrupts transmission therethrough of light having a wavelength of less than 590 nm.

28. An electroluminescent element according to claim 22, wherein said first electrode is composed of reflective metallic film.

29. An electroluminescent element according to claim 22, wherein said first electrode is composed of a transparent electrode and a black color layer is formed on a rear face side of said first electrode.

30. An electroluminescent display apparatus comprising as a rear side element said electroluminescent element according to claim 22 and as a front side element another electroluminescent element that emits a blue color light.

31. An electroluminescent element comprising:

a first electrode formed on a substrate;

a first insulating layer formed on said first electrode;

a first luminescent layer formed on said first insulating layer, a second luminescent layer formed on said first luminescent layer, said second luminescent layer comprising a plurality of pieces arranged such that single layer portions of said first luminescent layer are exposed between adjacent ones of said pieces and stacked layer portions of said first luminescent layer are in stacked relationship with said second luminescent layer;

a second insulating layer formed on said second luminescent layer; and a second electrode formed on said second insulating layer, wherein said first and second luminescent layers have clamp electric field intensities different from each other so that the product of a dielectric constant and said clamp electric field intensity of said luminescent layer having a lower clamp electric field intensity is larger than the product of a dielectric constant and said clamp electric field intensity of said luminescent layer having a higher clamp electric field intensity.

32. An electroluminescent element according to claim 31, wherein said first luminescent layer is a layer deposited by sputtering and said second luminescent layer is a layer deposited on said first luminescent layer by evaporation.

33. An electroluminescent element according to claim 31, wherein said first luminescent layer is made of ZnS containing Tb and said second luminescent layer is made of ZnS containing Mn.

34. An electroluminescent element according to claim 33, wherein said stacked layer portions of said first luminescent layer have thicknesses equal to that of said single layer portions and said second luminescent layer has a thickness in the range of from 1,000 Å to 3,500 Å inclusive.

35. An electroluminescent element according to claim 33, wherein said stacked layer portions of said first luminescent layer have smaller thicknesses than said single layer portions of said first luminescent layer.

36. An electroluminescent element according to claim 33, wherein said second electrode is composed of a transparent conductive film and a red color filter is formed over said second electrode so as to correspond to a region where said second luminescent layer is disposed thereunder.

37. An electroluminescent element according to claim 36, wherein:

said first electrode comprises a plurality of first electrode lines and said second electrode comprises a plurality of second electrode lines;

said first electrode lines or said second electrode lines define column electrodes and the other of said first or second electrode lines define row electrodes, said column and row electrodes intersecting at right angles to collectively form a dot matrix;

said column electrodes comprise first column electrodes provided for said stacked layer portions and second column electrodes provided for said single layer portions; and said red color filter has a widthwise edge contacting an edge portion of one of said second column electrodes.

38. An electroluminescent display apparatus comprising as a rear side element that emits red and green color lights said electroluminescent element according to claim 37 and as a front side element another electroluminescent element that emits a blue color light, wherein:

said front side element is a dot-matrix transparent element comprising column and row electrodes arranged to intersect each other at a right angle;

respective row electrodes of said front side element and said rear side element have the same width and are disposed in parallel with each other to overlap each other; and said column electrodes of said front side element have a width equal to the width of a pixel of said rear side element and are disposed in parallel with said column electrodes of said rear side element to overlap with said first column electrodes and said second column electrodes of said rear side element, respectively, said pixel of said rear side element being composed of a subpixel for red color emission and a subpixel for green color emission.

39. An electroluminescent element according to claim 36, wherein said red color filter is a long pass filter which permits transmission therethrough of light having a wavelength of 590 nm or more and interrupts transmission therethrough of light having a wavelength of less than 590 nm.

40. An electroluminescent element according to claim 36, wherein said first electrode is composed of reflective metallic film.

41. An electroluminescent element according to claim 36, wherein said first electrode is composed of a transparent electrode and a black color layer is formed on a rear face side of said first electrode.

42. An electroluminescent display apparatus comprising as a rear side element said electroluminescent element according to claim 36 and as a front side element another electroluminescent element that emits a blue color light.

* * * * *